US011384637B2

(12) United States Patent
Hsu et al.

(10) Patent No.: US 11,384,637 B2
(45) Date of Patent: Jul. 12, 2022

(54) SYSTEMS AND METHODS FOR FORMATION FLUID SAMPLING

(71) Applicant: Schlumberger Technology Corporation, Sugar Land, TX (US)

(72) Inventors: Kai Hsu, Sugar Land, TX (US); Adriaan Gisolf, Houston, TX (US); Youxiang Zuo, Burnaby (CA); Yong Chang, Sugar Land, TX (US); Beatriz E. Barbosa, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 1529 days.

(21) Appl. No.: 14/534,813

(22) Filed: Nov. 6, 2014

(65) Prior Publication Data

US 2016/0130940 A1 May 12, 2016

(51) Int. Cl.

| | |
|---|---|
| ***E21B 49/10*** | (2006.01) |
| ***E21B 49/08*** | (2006.01) |
| *E21B 49/00* | (2006.01) |

(52) U.S. Cl.

CPC ..... *E21B 49/10* (2013.01); *E21B 49/08* (2013.01); *E21B 49/003* (2013.01); (Continued)

(58) Field of Classification Search

CPC ..... E21B 49/10; E21B 44/00; E21B 47/026; E21B 49/008; E21B 49/00; G01V 11/00; G01V 3/28; G01V 5/101

(Continued)

(56) References Cited

U.S. PATENT DOCUMENTS 6,871,713 B2 * 3/2005 Meister ..... E21B 44/00 166/250.01
7,346,460 B2 * 3/2008 DiFoggio ..... G01N 7/00 702/50

(Continued)

FOREIGN PATENT DOCUMENTS

GB 2418938 A 4/2006
GB 2429728 A 3/2007

(Continued)

OTHER PUBLICATIONS

Combined Search Report and Examination issued in related GB application GB1518716.4 dated May 20, 2016, 7 pages.

(Continued)

*Primary Examiner* — Kyle R Quigley
*Assistant Examiner* — Leonard S Liang
(74) *Attorney, Agent, or Firm* — Trevor G. Grove

(57) ABSTRACT

Embodiments of the disclosure can include systems and methods for formation fluid sampling. In one embodiment, a method can include monitoring a relationship between a first characteristic of a formation fluid extracted from a formation and a second characteristic of the formation fluid extracted from the formation, determining, based at least in part on the monitoring, that a linear trend is exhibited by the relationship between the first characteristic of the formation fluid extracted from the formation and the second characteristic of the formation fluid extracted from the formation, and determining a reservoir fluid breakthrough based at least in part on the identification of the linear trend, wherein the reservoir fluid breakthrough is indicative of virgin reservoir fluid entering a sampling tool.

13 Claims, 9 Drawing Sheets

(52) U.S. Cl.
CPC ..... *E21B 49/008* (2013.01); *E21B 49/081* (2013.01); *E21B 49/088* (2013.01)

(58) Field of Classification Search
USPC ..... 702/6, 8, 11, 7, 9, 10, 12, 13; 700/266, 700/282; 73/152.24, 152.23, 152.18; 166/264, 100, 105, 250.02, 255.2, 250.15, 166/57, 302
See application file for complete search history.

(56) References Cited

U.S. PATENT DOCUMENTS 7,458,252 B2 * 12/2008 Freemark ..... E21B 49/10 73/64.45
7,805,988 B2 10/2010 Kasperski et al.
8,024,125 B2 * 9/2011 Hsu ..... E21B 49/10 702/11
8,714,246 B2 * 5/2014 Pop ..... E21B 7/04 166/264
9,752,432 B2 * 9/2017 Smits ..... E21B 49/10
10,073,042 B2 * 9/2018 Wang ..... G01N 33/2823
2006/0000603 A1 * 1/2006 Zazovsky ..... E21B 49/10 166/244.1
2006/0076132 A1 * 4/2006 Nold, III ..... E21B 49/10 166/264
2007/0044572 A1 * 3/2007 Davis ..... G01F 1/66 73/861.42
2007/0079962 A1 * 4/2007 Zazovsky ..... E21B 49/008 166/264
2007/0284099 A1 * 12/2007 DiFoggio ..... E21B 49/08 166/264
2008/0111551 A1 * 5/2008 Freedman ..... G01V 8/02 324/324
2008/0149332 A1 * 6/2008 Gordon ..... E21B 49/088 166/264
2008/0156088 A1 * 7/2008 Hsu ..... E21B 49/10 73/152.23
2008/0156486 A1 * 7/2008 Ciglenec ..... E21B 49/10 166/250.15
2008/0314139 A1 * 12/2008 DiFoggio ..... E21B 47/10 73/152.55
2009/0296086 A1 * 12/2009 Appel ..... E21B 49/10 356/326
2009/0308601 A1 * 12/2009 Poe, Jr. ..... E21B 47/06 166/250.01
2012/0132419 A1 * 5/2012 Zazovsky ..... E21B 49/10 166/264
2014/0180591 A1 6/2014 Hsu et al.
2014/0196532 A1 * 7/2014 Bullock ..... E21B 49/10 73/152.24
2015/0176407 A1 * 6/2015 Indo ..... G01N 21/31 702/6
2015/0211363 A1 * 7/2015 Pop ..... E21B 49/081 73/152.28
2015/0308264 A1 * 10/2015 Zuo ..... E21B 49/088 702/6
2016/0090836 A1 * 3/2016 Wang ..... E21B 49/08 702/12
2016/0178599 A1 * 6/2016 Gisolf ..... E21B 49/087 73/23.35

FOREIGN PATENT DOCUMENTS

GB 2450436 A * 12/2008 ..... E21B 49/10
WO WO-2009064691 A1 * 5/2009 ..... E21B 49/087

OTHER PUBLICATIONS

Del Campo, et al. "Advances in Fluid Sampling with Formation Testers for Offshore Exploration," OTC 18201, 2006 Offshore Technology Conference, Houston, Texas, U.S.A., May 1-4, 2006, pp. 1-10.
Hsu, et al. "Multichannel oil-base mud contamination monitoring using downhole optical spectrometer," SPWLA 49th Annual Logging Symposium, Edinburgh, Scotland, May 25-28, 2008, pp. 1-13.
O'Keefe, et al. "Focused Sampling of Reservoir Fluids Achieves Undetectable Levels of Contamination," SPE 101084, 2006 SPE Asia Pacific Oil & Gas Conference and Exhibition, Adelaide, Australia, Sep. 11-13, 2006, pp. 1-20.
Weinheber, et al. "New Formation Tester Probe Design for Low-Contamination Sampling," Paper Q, SPWLA 47th Annual Logging Symposium, Veracruz, Mexico, Jun. 4-7, 2006, pp. 1-11.
U.S. Appl. No. 14/164,991, filed Jan. 27, 2014.

* cited by examiner

SYSTEMS AND METHODS FOR FORMATION FLUID SAMPLING

BACKGROUND

Wellbores (also known as boreholes) are drilled to penetrate subterranean formations for hydrocarbon prospecting and production. During drilling operations, evaluations may be performed of the subterranean formation for various purposes, such as to locate hydrocarbon-bearing formations and to manage the production of hydrocarbons from these formations. To conduct formation evaluations, a drill string may include one or more drilling tools that test and/or sample the surrounding formation, or the drill string may be removed from the wellbore, and a wireline tool may be deployed into the wellbore to test and/or sample the formation. These drilling tools and wireline tools, as well as other wellbore tools conveyed on coiled tubing, drill pipe, casing or other conveyers, can also be referred to as "downhole tools."

Formation evaluation may involve drawing fluid from the formation, also referred to as "formation fluid," into a downhole tool for testing and/or sampling. Various devices, such as probes and/or packers, may be extended from the downhole tool to isolate a region of the wellbore wall, and thereby establish fluid communication with the subterranean formation surrounding the wellbore. Fluid may then be drawn into the downhole tool using the probe and/or packer. Within the downhole tool, the fluid may be directed to one or more fluid analyzers and sensors that may be employed to detect properties of the fluid. The properties of the fluid may be employed to determine reservoir architecture, connectivity, and compositional gradients, among others.

SUMMARY

Embodiments of the disclosure can include systems and methods for formation fluid sampling. In one embodiment, a method can include monitoring a relationship between a first characteristic of a formation fluid extracted from a formation and a second characteristic of the formation fluid extracted from the formation, determining, based at least in part on the monitoring; that a linear trend is exhibited by the relationship between the first characteristic of the formation fluid extracted from the formation and the second characteristic of the formation fluid extracted from the formation; and determining a reservoir fluid breakthrough based at least in part on the identification of the linear trend, where the reservoir fluid breakthrough is indicative of virgin reservoir fluid entering a sampling tool.

In another embodiment, a non-transitory computer-readable storage medium may be provided that includes computer-executable instructions that are executable by processors to cause: monitoring a relationship between a first characteristic of a formation fluid extracted from a formation and a second characteristic of the formation fluid extracted from the formation; determining, based at least in part on the monitoring, that a linear trend is exhibited by the relationship between the first characteristic of the formation fluid extracted from the formation and the second characteristic of the formation fluid extracted from the formation; and determining a reservoir fluid breakthrough based at least in part on the identification of the linear trend, where the reservoir fluid breakthrough is indicative of virgin reservoir fluid entering a sampling tool.

In yet another embodiment, a system may be provided that includes a formation sampling tool having a first flowline, a second flowline, and a controller. The controller may include processors and memories storing computer-executable instructions, that are executable by the processors to cause the following: monitoring a relationship between a first characteristic of a formation fluid extracted from a formation and a second characteristic of the formation fluid extracted from the formation; determining, based at least in part on the monitoring, that a linear trend is exhibited by the relationship between the first characteristic of the formation fluid extracted from the formation and the second characteristic of the formation fluid extracted from the formation; determining a reservoir fluid breakthrough based at least in part on the identification of the linear trend, where the reservoir fluid breakthrough is indicative of virgin reservoir fluid entering a sampling tool; in response to identifying the reservoir fluid breakthrough, splitting the flow of the formation fluid entering the sampling tool such that a portion of the formation fluid is directed into the first flowline and a portion of the formation fluid is directed into the second flowline; monitoring a contamination level of the formation fluid directed into the first flowline; determining that the contamination level of the formation fluid directed into the first flowline falls below a contamination threshold; and in response to determining that the contamination level of the formation fluid directed into the first flowline falls below the contamination threshold, sampling the formation fluid directed into the first flowline.

This summary is provided to introduce a selection of concepts in a simplified form that are further described below in the detailed description. This summary is not intended to identify key features or essential features of the claimed subject matter, nor is it intended to be used to limit the scope of the claimed subject matter.

Figure 1:
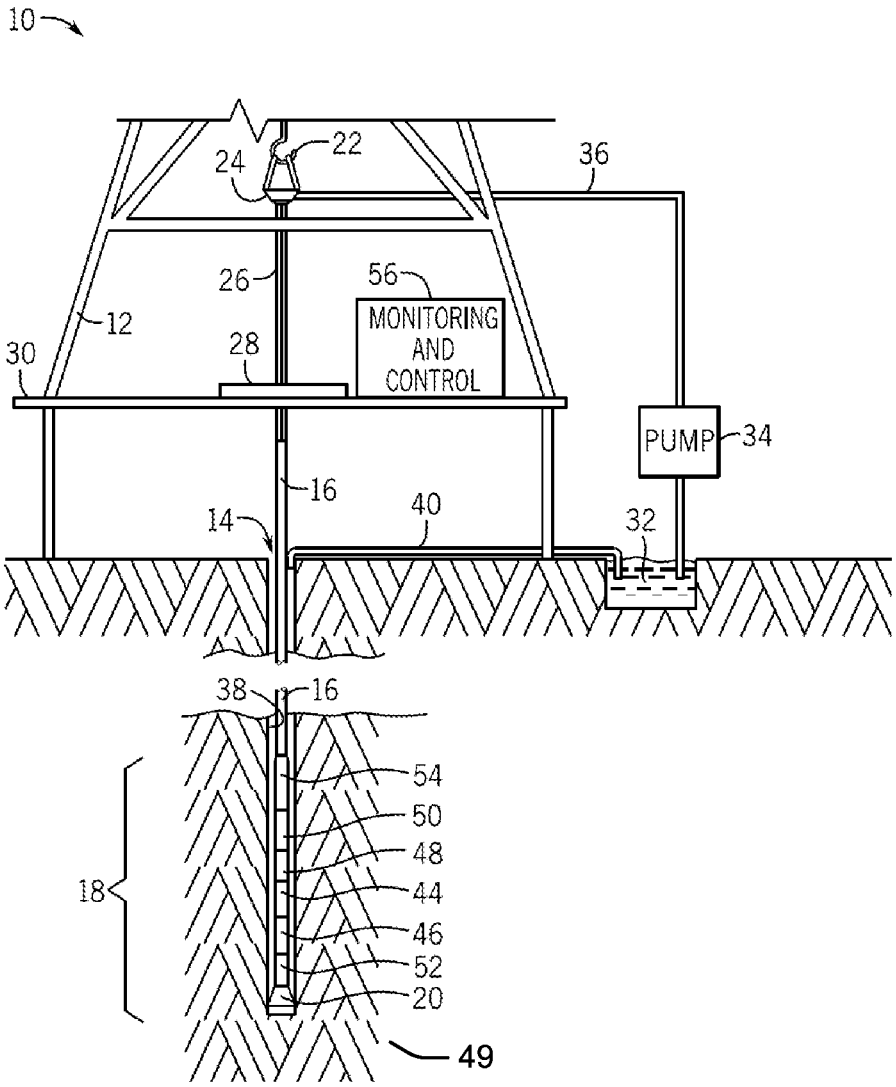
FIG. 1 is a diagram that illustrates an example drilling system in accordance with one or more embodiments.

While the disclosure is susceptible to various modifications and alternative forms, specific embodiments thereof are shown by way of example in the drawings and will herein be described in detail. The drawings may not be to scale. It should be understood, however, that the drawings and detailed description thereto are not intended to limit the disclosure to the particular form disclosed, but to the contrary, the intention is to cover all modifications, equivalents, and alternatives falling within the spirit and scope of the present disclosure as defined by the appended claims.

DETAILED DESCRIPTION

The present disclosure relates to formation fluid sampling operations, including identifying a breakthrough of virgin formation fluid, and conducting post-breakthrough operations. The post-breakthrough operations may include, for example, splitting the flow of formation fluid (in a focused sampling operation), performing contamination monitoring, acquiring a sample of the formation fluid, performing a normalization procedure, performing non-focused sampling operations and/or the like. Although certain embodiments, are described in the context of focused sampling operations (e.g., including splitting the flow of formation fluid) for the purpose of illustration, similar techniques can be employed with other operations, such as non-focused sampling operations (e.g., contamination monitoring and/or sampling operations that do not employ splitting the flow of the formation fluid). In some embodiments, identifying a breakthrough of virgin formation fluid during a sampling operation includes real-time monitoring of relationships between characteristics (or properties) of the formation fluid being extracted from the formation during the sampling operation. In the case of sampling hydrocarbon-based formation fluid (e.g., oil), the characteristics may include, for example, optical density, fluid density, and/or the like. In the case of sampling water-based formation fluid (e.g., connate water), the characteristics may include, for example, resistivity (or conductivity), fluid density, optical density, and/or the like. In some embodiments, the breakthrough of virgin formation fluid can be identified based on a linear trend exhibited by the relationships between the characteristics. Thus, a sampling operation may include extracting formation fluid from a formation, monitoring relationships between characteristics of the extracted formation fluid, identifying a breakthrough of virgin formation fluid based on a linear trend exhibited by the monitored relationships, and conducting post-breakthrough operations (e.g., splitting the flow of formation fluid, performing contamination monitoring, acquiring a sample of the formation fluid, performing a normalization operation, and/or the like).

As noted above and discussed more fully below, the formation fluid sampling operations can be used in sampling and scanning/analyzing fluids in hydrocarbon reservoirs or water reservoirs. Such formation fluid sampling operations can be performed with downhole tools of various wellsite systems, such as drilling systems and wireline systems. Embodiments of two such systems are depicted in FIGS. 1 and 2 by way of example.

Figure 2:
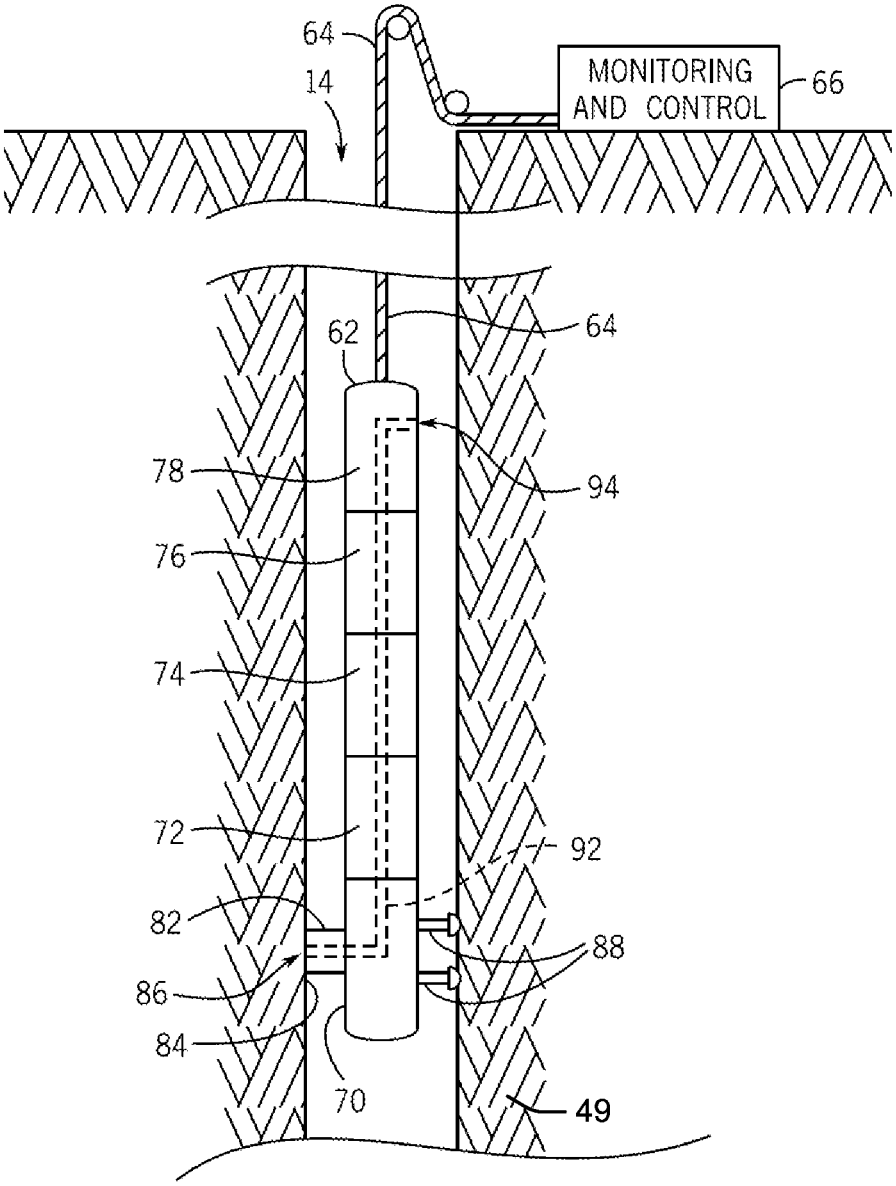
FIG. 2 is a diagram that illustrates an example fluid sampling tool deployed within a well in accordance with one or more embodiments.

FIG. 1 is a diagram that illustrates an example drilling system 10 in accordance with one or more embodiments. While certain elements of the drilling system 10 are depicted in this figure and generally discussed below, it will be appreciated that the drilling system 10 may include variations, including other components provided in addition to, or in place of, those presently illustrated and discussed. As depicted, the drilling system 10 can include a drilling rig 12 positioned over a well 14. Although depicted as an onshore drilling system 10, it is noted that the drilling system could instead be an offshore drilling system. The drilling rig 12 can support a drill string 16 that includes a bottomhole assembly 18 having a drill bit 20. The drilling rig 12 can rotate the drill string 16 (and its drill bit 20) to drill the well 14.

The drill string 16 may be suspended within the well 14 from a hook 22 of the drilling rig 12 via a swivel 24 and a kelly 26. Although not depicted in FIG. 1, the skilled artisan will appreciate that the hook 22 can be connected to a hoisting system used to raise and lower the drill string 16 within the well 14. As one example, such a hoisting system could include a crown block and a drawworks that cooperate to raise and lower a traveling block (to which the hook 22 is connected) via a hoisting line. The kelly 26 may be coupled to the drill string 16, and the swivel 24 may allow the kelly 26 and the drill string 16 to rotate with respect to the hook 22. A rotary table 28 on a drill floor 30 of the drilling rig 12 can be provided to grip and turn the kelly 26 to drive rotation of the drill string 16 to drill the well 14. In some embodiments, a top drive system can be used to drive rotation of the drill string 16.

During operation, drill cuttings or other debris may collect near the bottom of the well 14. Drilling fluid 32, also referred to as drilling mud, can be circulated through the well 14 to remove this debris. The drilling fluid 32 may also clean and cool the drill bit 20 and provide positive pressure within the well 14 to inhibit formation fluids from entering the wellbore. The drilling fluid 32 may be circulated through the well 14 by a pump 34. The drilling fluid 32 may be pumped from a mud pit (or some other reservoir, such as a mud tank) into the drill string 16 through a supply conduit 36, the swivel 24, and the kelly 26. The drilling fluid 32 may exit near the bottom of the drill string 16 (e.g., at the drill bit 20) and return to the surface through an annulus 38 between the wellbore and the drill string 16. A return conduit 40 can transmit the returning drilling fluid 32 away from the well 14. In some embodiments, the returning drilling fluid 32 can be cleansed (e.g., via one or more shale shakers, desanders, or desilters) and reused in the well 14.

In addition to the drill bit 20, the bottomhole assembly 18 can also include various instruments that measure information of interest within the well 14. For example, as depicted in FIG. 1, the bottomhole assembly 18 may include a logging-while-drilling (LWD) module 44 and a measurement-while-drilling (MWD) module 46. Both modules may include sensors, e.g., housed in drill collars, that collect data and enable the creation of measurement logs in real-time during a drilling operation. The modules may also include memory devices for storing the measured data. The LWD module 44 may include sensors that measure various characteristics of the rock and formation fluid properties within the well 14. Data collected by the LWD module 44 can include measurements of gamma rays, resistivity, neutron porosity, formation density, sound waves, optical density, and/or the like. The MWD module 46 may include sensors that measure various characteristics of the bottomhole assembly 18 and the wellbore, such as orientation (azimuth and inclination) of the drill bit 20, torque, shock and vibration, the weight on the drill bit 20, downhole temperature and pressure, and/or the like. The data collected by the MWD module 46 can be used to control drilling operations. The bottomhole assembly 18 may also include one or more additional modules 48, such as LWD modules, MWD modules, or other modules. It is noted that the bottomhole assembly 18 can be modular and, thus, the positions and presence of particular modules of the assembly may be changed as desired. Further, as discussed in greater detail below, one or more of the modules 44, 46, and 48 may be or may include a fluid sampling tool configured to obtain a sample of a fluid from a subterranean formation and perform downhole fluid analysis to measure various properties of the sampled fluid, which can then be used to determine the breakthrough of a formation fluid during a sampling operation and the general characteristics of the formation 49.

The bottomhole assembly 18 can also include other modules, such as a power module 50, a steering module 52, and/or a communication module 54. In one embodiment, the power module 50 may include a generator (such as a turbine) driven by the flow of drilling mud through the drill string 16. In other embodiments, the power module 50 may include other forms of power storage or generation, such as batteries or fuel cells. The steering module 52 may include a rotary-steerable system that facilitates directional drilling of the well 14. The communication module 54 may enable communication of data (e.g., data collected by the LWD module 44 and the MWD module 46) between the bottomhole assembly 18 and the surface. In one embodiment, the communication module 54 communicates via mud pulse telemetry, in which the communication module 54 uses the drilling fluid 32 in the drill string 16 as a propagation medium for a pressure wave encoding the data to be transmitted.

The drilling system 10 may also include a monitoring and control system 56. The monitoring and control system 56 may include one or more computer systems that enable monitoring and control of various components of the drilling system 10. The monitoring and control system 56 may also receive data from the bottomhole assembly 18 (e.g., data from the LWD module 44, the MWD module 46, and the additional module 48) for processing and/or communication to an operator, for example. Although depicted on the drill floor 30 in FIG. 1, the monitoring and control system 56 can be positioned elsewhere. Further, the monitoring and control system 56 can be a distributed system with elements provided at different places near or remote from the well 14.

An additional example of using a downhole tool for formation testing is depicted in FIG. 2. FIG. 2 is a diagram that illustrates an example fluid sampling tool 62 deployed within a well 14 in accordance with one or more embodiments. The fluid sampling tool 62 may be suspended in the well 14 on a cable 64. The cable 64 may be a wireline cable with at least one conductor that enables data transmission between the fluid sampling tool 62 and a monitoring and control system 66. The cable 64 may be raised and lowered within the well 14 in any suitable manner. For instance, the cable 64 can be reeled from a drum in a service truck, which may be a logging truck having the monitoring and control system 66. The monitoring and control system 66 may control movement of the fluid sampling tool 62 within the well 14 and/or receive data from the fluid sampling tool 62. The monitoring and control system 66 may include one or more computer systems or devices and may be a distributed computing system, e.g., similar to that of the monitoring and control system 56 of FIG. 1. The received data may be stored, communicated to an operator, processed, and/or the like. Although the fluid sampling tool 62 is depicted as being deployed via a wireline, in some embodiments the fluid sampling tool 62 (or at least its functionality) may be incorporated into one or more modules of the bottomhole assembly 18, such as the LWD module 44 or the additional module 48.

The fluid sampling tool 62 may take various forms. Although depicted in FIG. 2 as having a body including a probe module 70, a fluid analysis module 72, a pump module 74, a power module 76, and a fluid storage module 78, the fluid sampling tool 62 may include different modules in other embodiments. The probe module 70 may include a probe 82 that can be extended (e.g., hydraulically driven) and pressed into engagement against a wall 84 of the well 14 to draw (or extract) fluid (or formation fluid) from the formation 49 into the fluid sampling tool 62 via an intake 86. As depicted, the probe module 70 can also include one or more setting pistons 88 that may be extended outwardly to engage the wall 84 and push an end face of the probe 82 against another portion of the wall 84. In some embodiments, the probe 82 may include a sealing element or packer that isolates the intake 86 from the rest of the wellbore. In other embodiments the fluid sampling tool 62 can include one or more inflatable packers that can be extended from the body of the fluid sampling tool 62 to circumferentially engage the wall 84 and isolate a region of the well 14 near the intake 86 from the rest of the wellbore. In such embodiments, the extendable probe 82 and the setting pistons 88 may be omitted, and the intake 86 may be provided in the body of the fluid sampling tool 62, such as in the body of a packer module housing an extendable packer.

The power module 76 may provide power to electronic components of the fluid sampling tool 62. The pump module 74 may be operated to draw formation fluid into the intake 86, through a flowline 92. The formation fluid may, then, be expelled into the wellbore through an outlet 94, or directed into a storage container (e.g., a sample bottle within the fluid storage module 78) for transport back to the surface when the fluid sampling tool 62 is removed from the well 14. The fluid analysis module (or fluid analyzer) 72 may include one or more sensors for measuring properties of the sampled formation fluid, such as the optical density (OD) of the formation fluid. The sensors may include, for example, optical spectrometers, fluid density sensors, resistivity sensors, viscosity sensors, nuclear magnetic resonance (NMR) sensors, dielectric sensors, ultrasonic sensors, and/or the like. In some embodiments, the fluid analysis module 72 may include a multi-channel (e.g., 20 channel) spectrometer that measures the optical density (OD) of a fluid (e.g., the sampled formation fluid) at multiple discrete wavelengths (e.g., 20 discrete wavelengths) in the visible to near-infrared (NIR) portion of the spectrum.

The drilling and wireline environments depicted in FIGS. 1 and 2 are examples of environments in which a fluid sampling tool 62 may be used to facilitate retrieval and/or analysis of a downhole fluid. The presently disclosed techniques, however, can be implemented in other environments as well. For instance, the fluid sampling tool 62 may be deployed in other manners, such as by a slickline, coiled tubing, or a pipe string. Additional details on the construction and operation of the fluid sampling tool 62 may be better understood through reference to FIG. 3.

Figure 3:
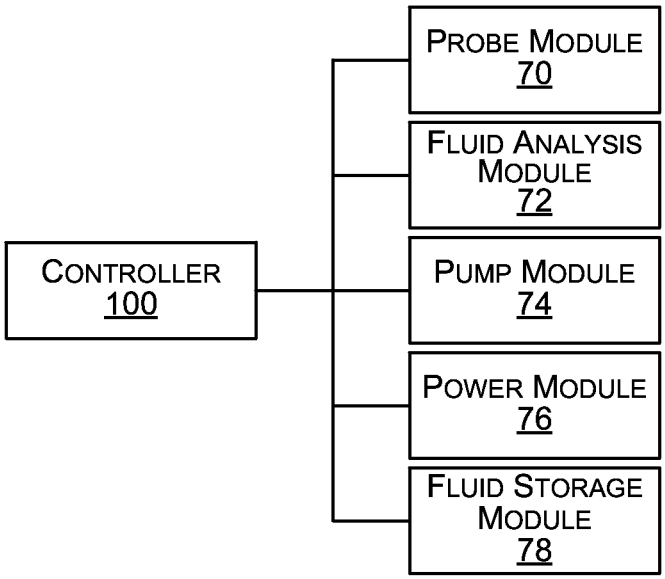
FIG. 3 is a diagram that illustrates example components of a fluid sampling tool in accordance with one or more embodiments.

FIG. 3 is a diagram that illustrates example components of a fluid sampling tool 62 in accordance with one or more embodiments. In the illustrated embodiment, each of a probe module 70, a fluid analysis module 72, a pump module 74, a power module 76, and a fluid storage module 78 are communicatively coupled to a controller 100. In some embodiments, the controller 100 can be employed to control operation of the modules and their respective components. The control module 100 may provide control commands that cause various components of the fluid sampling tool to perform the operations of the fluid sampling techniques described herein. For example, the controller 100 may command the probe module 70 to engage the well with the probe 82, and the probe module 70 may, in turn, extend the probe 82 and the setting pistons 88 into contact with the wall 84 of the well 14 to facilitate sampling of a formation fluid through the wall 84 of the well 14. The controller 100 may, for example, command the pump module 74 to generate flow through one or more flowlines of the fluid sampling tool 62, and the pump module 74 may, in turn, operate one or more pumps to generate the flow through one or more flowlines of the fluid sampling tool 62. The controller 100 may command the fluid analysis module 72 to acquire various measurements of a fluid flowing through the fluid sampling tool 62, and the fluid analysis module 72 may, in turn, operate one or more sensors of the fluid analysis module to acquire the various measurements. The sensors may include, for example, optical spectrometers, fluid density sensors (e.g., densitometers), resistivity sensors, viscosity sensors, nuclear magnetic resonance (NMR) sensors, dielectric sensors, ultrasonic sensors, and/or the like. The fluid analysis module 72 may communicate the resulting measurement data to the controller 100 for use in various aspects of a sampling operation. For example, the fluid analysis module 72 may communicate resulting measurements for reservoir pressure (Pres) and temperature (T), optical density (OD), fluid density (ρ), fluid viscosity (μ), electrical resistivity or conductivity, saturation pressure, and fluorescence and/or the like for the formation fluid, to the controller 100. The controller 100 may, in turn, use the data for determining relationships between various characteristics of the formation fluid, for determining a contamination level of the formation fluid, and/or the like. The controller 100 may also use these determined relationships to identify a reservoir fluid breakthrough (e.g., based on whether a linear relationship indicative of a reservoir fluid breakthrough is exhibited by the relationships). Further, the controller 100 may, for example, command the fluid storage module 78 to acquire one or more samples of the formation fluid, and the fluid storage module 78 may, in turn, operate a sample valve to divert at least a portion of the formation fluid flowing through the fluid sampling tool 62 into a container, such as one or more sample bottles.

Figure 4:
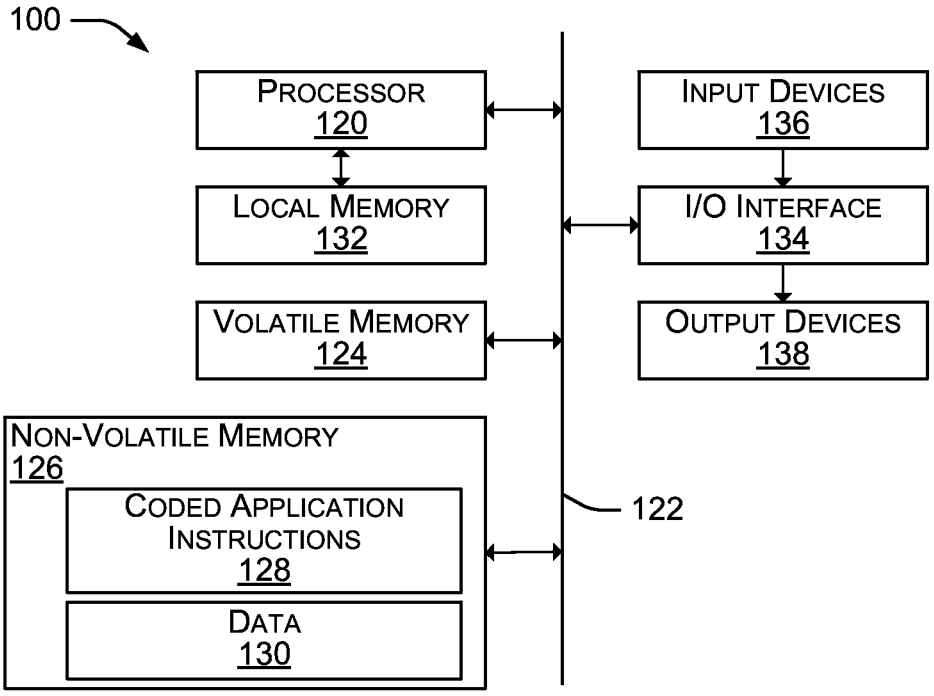
FIG. 4 is a diagram that illustrates an example controller in accordance with one or more embodiments.

In some embodiments, the controller 100 can be a processor-based system, such as that illustrated in FIG. 4. FIG. 4 is a diagram that illustrates an example controller 100 in accordance with one or more embodiments. The controller 100 may include at least one processor 120 connected, by a bus 122, to volatile memory 124 (e.g., random-access memory) and/or non-volatile memory 126 (e.g., flash memory and a read-only memory (ROM)). Coded application instructions 128 (e.g., software that may be executed by the processor 120 to enable the control and analysis functionality described herein) and data 130 (e.g., acquired measurements and/or the results of processing) may be stored in the non-volatile memory 126. For example, the coded application instructions 128 can be stored in a ROM, and the data can be stored in a flash memory. The coded application instructions 128 and the data 130 may also be loaded into the volatile memory 124 or a local memory 132 of the processor 120. The memories 124 and 126 may include one or more non-transitory computer-readable storage medium having program instructions (e.g., coded application instructions 128) stored thereon that are executable by one or more processors (e.g., processor 120) to cause various operations, including those described herein (e.g., including some or all of the operational aspects of the method 800 described in more detail below with regard to FIG. 8).

An input/output (I/O) interface 134 of the controller 100 may enable communication between the processor 120, the input devices 136, and the output devices 138. The I/O interface 134 can include any suitable device that enables such communication, such as a modem or a serial port. In some embodiments, the input devices 136 can include one or more sensing components of the fluid sampling tool 62, such as sensors of the fluid analysis module 72, and the output devices 138 can include displays, printers, and storage devices that allow output of data received or generated by the controller 100. Input devices 136 and output devices 138 may be provided as part of the controller 100, although in other embodiments such devices may be separately provided.

The controller 100 can be provided as part of the monitoring and control systems 56 or 66 outside of a well 14 to enable downhole fluid analysis of samples obtained by the fluid sampling tool 62. In such embodiments, data collected by the fluid sampling tool 62 can be transmitted from the well 14 to the surface for analysis by the controller 100. In some other embodiments, the controller 100 is provided within a downhole tool in the well 14, such as within the fluid sampling tool 62, or in another component of the bottomhole assembly 18. This can enable downhole fluid analysis (DFA) to be performed within the well 14. Further, the controller 100 may be a distributed system with some components located in a downhole tool and others provided elsewhere (e.g., at the surface of the wellsite). Whether provided within or outside the well 14, the controller 100 can receive data collected by the sensors within the fluid sampling tool 62 and process this data to determine one or more characteristics of interest for the sampled fluid.

Figure 5A:
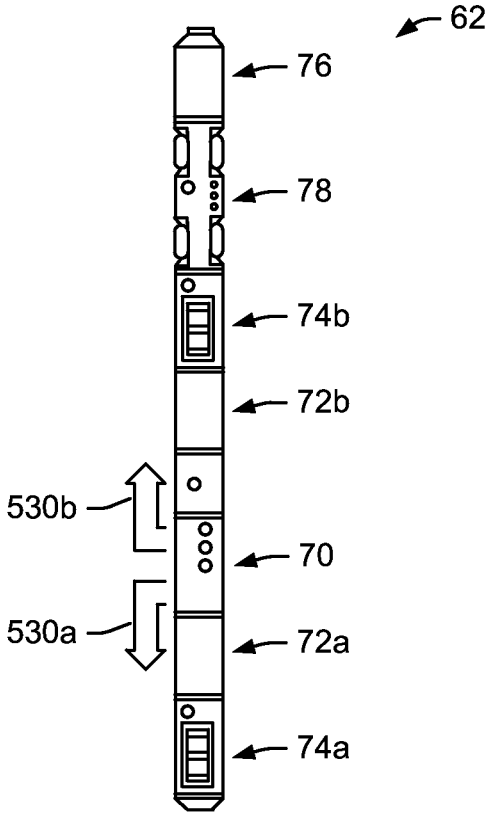
FIGS. 5A and 5B are diagrams that illustrate an example fluid sampling tool in accordance with one or more embodiments.
Figure 5B:
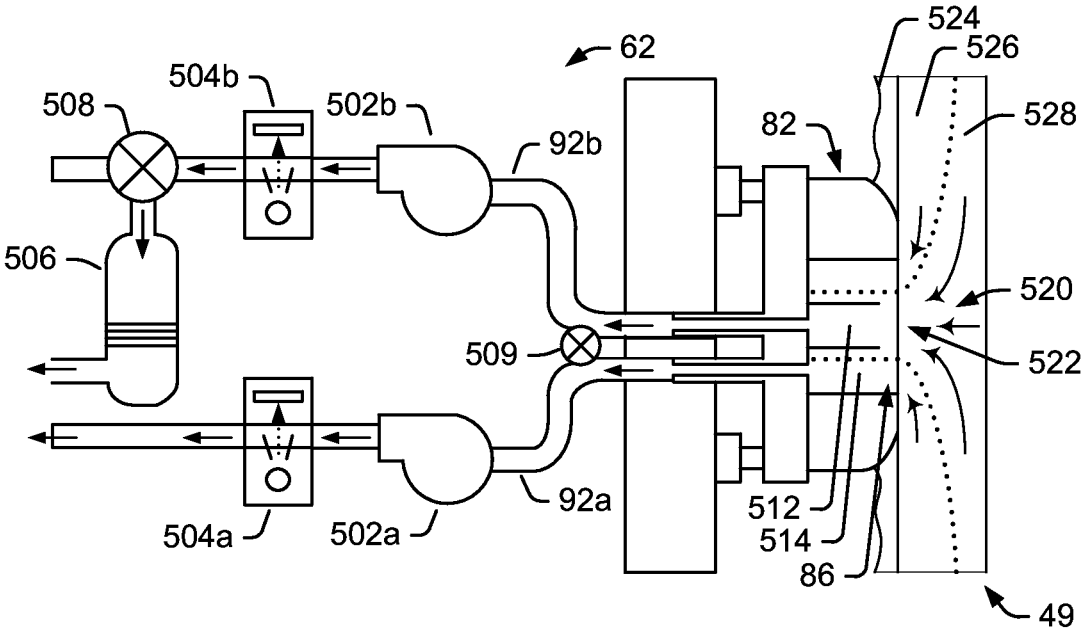

FIGS. 5A and 5B illustrate aspects of an example fluid sampling tool 62 in accordance with one or more embodiments. FIG. 5A illustrates a set of tool modules of the example fluid sampling tool 62. FIG. 5B is a functional diagram that illustrates an example configuration of various elements of the fluid sampling tool 62 in accordance with one or more embodiments. The fluid sampling tool 62 of FIGS. 5A and 5B may be, for example, a focused fluid sampling tool that can be used for focused sampling of formation fluids as described herein.

Referring to FIG. 5A, the fluid sampling tool 62 may include a power module 76, a fluid storage module 78, a "sample" pump module 74*b*, a "sample" fluid analyzer module 72*b*, a probe module 70, a "guard" fluid analysis module 72*a*, and a "guard" pump module 74*b*. Referring to FIG. 5B, the fluid sampling tool 62 may include a focused sampling probe 82, a "guard" flowline 92*a*, a "guard" pump 502*a*, a "guard" fluid analyzer 504*a*, a "sample" flowline 92*b*, a sample pump 502*b*, a "sample" fluid analyzer 504*b*, one or more sample bottles 506, a sample valve 508, and a flowline bypass valve (or seal valve) 509. Referring to both FIGS. 5A and 5B, the focused sampling probe 82 may be a component of the probe module 70, the guard pump 502*a* may be a component of the guard pump module 74*b*, the guard fluid analyzer 504*a* may be a component of the guard fluid analysis module 72*a*, the sample pump 502*b* may be a component of the sample pump module 74*b*, the sample fluid analyzer 504*b* may be a component of the sample fluid analyzer module 72*b*, and the one or more sample bottles 506 and the sample valve 508 may be components of the fluid storage module 78. The flowline bypass valve 509 may be a component of the guard or sample pump modules 74*a* and 74*b*.

During a sampling operation, an intake 86 of the focused sampling probe 82 may be extended into engagement with the wall 84 of the well 14. The intake 86 may include a primary inlet (or central inlet) 512 and a secondary inlet (or annular inlet) 514. The primary inlet 512 may include a central region of the intake 86, and the secondary inlet 514 may include the annular region surrounding the primary inlet 512. During operation, formation fluid 520 may be drawn from a sampling zone 522 (e.g., at the wall 84 of the well 14) into the intake 86. The formation fluid 520 near the center of the sampling zone 522 may be drawn into the primary inlet 512, and the formation fluid 520 near the outside edge of the intake 86 and sampling zone 522 may be drawn into the secondary inlet 514. In an example sampling operation, debris of mud cake 524 on or at the wall 84 may be initially drawn into the intake 86. As pumping continues, the filtrate fluid 526 adjacent to the wall 84 may be drawn into the intake 86 and, as pumping further continues, the virgin formation fluid 528 adjacent to and behind the filtrate fluid 526 may be drawn into the intake 86. Each of the transitions from drawing in one fluid to the next may include a period characterized by drawing in a large mixture of the respective fluids.

A "breakthrough" or "breakthrough time" may refer to a point in time at which the virgin formation fluid (or reservoir fluid) 528 enters the intake 86. Thus, for example, a sampling operation may include drawing in the mud cake 524, followed by drawing in the filtrate fluid 526, and further followed by drawing in the virgin formation fluid 528. The start of drawing in the virgin formation fluid 528 may be referred to as the breakthrough of the virgin formation fluid 528. The illustrated embodiment of FIG. 5B depicts a point in time after breakthrough of the virgin formation fluid 528 has occurred. This is represented by the virgin formation fluid 528 already being drawn into the intake 86. Notably, in the illustrated embodiment, the formation fluid 520 drawn into the secondary inlet 514 includes a high concentration of filtrate fluid 526, and the formation fluid 520 drawn into the primary inlet 512 includes primarily virgin formation fluid 528 with a low concentration of filtrate.

The primary inlet 512 may be connected to the sample flowline 92*b*. The secondary inlet 514 may be connected to the guard flowline 92*a*. During operation, the sample pump 502*b* can be operated to draw formation fluid 520 into the sample flowline 92*b* via the primary inlet 512, and/or the guard pump 502*a* can be operated to draw formation fluid 520 into the guard flowline 92*a* via the secondary inlet 514. As discussed herein, in some configurations of the fluid sampling tool 62, the formation fluid 520 drawn into the sample flowline 92*b* may be passed through the sample fluid analyzer 504*b*, and the formation fluid 520 drawn into the guard flowline 92*a* may be passed through the guard fluid analyzer 504*a*. As discussed herein, in some instances, the sample valve 508 may be operated to divert at least a portion of the formation fluid 520 into the sample bottle 506 (e.g., from the flow of formation fluid 520 flowing through the sample flowline 92*b*). As discussed herein, in some configurations of the fluid sampling tool 62, the flowline bypass valve 509 is set in a position to block one of the flowlines (either the guard flowline 92*a* or the sample flowline 92*b*). If the guard flowline 92*a* is blocked, formation fluid 520 from both of the primary inlet 512 and the secondary inlet 514 may be pumped through the sample flowline 92*b* using the sample pump 502*b*. If the sample flowline 92*b* is blocked, formation fluid 520 from both of the primary inlet 512 and the secondary inlet 514 may be pumped through the guard flowline 92*a* using the guard pump 502*a*. Therefore, there may be only one pump operating in some configurations. In the split-flow configuration, the flowline bypass valve 509 can be set in the position to isolate the two flowlines 92*a* and 92*b*, and the two pumps 502*a* and 502*b* are operated independently to draw formation fluid 520 from the formation 49. For example, the flowline bypass valve 509 can be set in a position to maintain isolation between the formation fluid 520 flowing through the sample flowline 92*b* and the formation fluid 520 flowing through the guard flowline 92*a*. In this configuration, the sample pump 502*b* can be operated to draw formation fluid 520 through the primary inlet 512 and the sample flowline 92*b*, and the guard pump 502*a* can be operated to draw formation fluid 520 through the secondary inlet 514 and the guard flowline 92*a*.

The fluid sampling tool 62 can be operated in different configurations. In a "commingled-down" configuration, the flowline bypass valve 509 between the guard and sample flowlines 92*a* and 92*b* may be opened, and the guard pump 502*a* may be operated. In such a configuration, the flow of the formation fluid 520 drawn through the primary inlet 512 may be mixed with the formation fluid 520 drawn through the secondary inlet 514. Further, the mixed formation fluid 520 may be routed through the guard flowline 92*a* such that it passes through the guard fluid analyzer 504*a* before exiting the fluid sampling tool 62. The guard fluid analyzer 504*a* may be operated to analyze and monitor the formation fluid 520 flowing through the guard flowline 92*a*. The formation fluid 520 may exit the fluid sampling tool 62 (e.g., be pumped down and expelled into the wellbore) as indicated by the downward arrow 530*a* of FIG. 5A. In this configuration, the sample pump 502*b* may not be operated. In such an instance, the sample flowline 92*b* may be blocked, and the sample fluid analyzer 504*b* may not be operated because there is no flow of formation fluid 520 through the sample flowline 92*b* to be analyzed. This configuration can be used for initial clean-up (e.g., to draw the mud cake 524 and the filtrate fluid 526 through the fluid sampling tool 62 to reach the virgin formation fluid 528).

In a "commingled-up" configuration, the flowline bypass valve 509 between the guard and sample flowlines 92*a* and 92*b* may be opened, and the sample pump 502*b* may be operated. In such a configuration, the flow of the formation fluid 520 drawn through the primary inlet 512 may be mixed with the formation fluid 520 drawn through the secondary inlet 514. Further, the mixed formation fluid 520 may be routed through the sample flowline 92*b* such that it passes through the sample fluid analyzer 504*b* before exiting the fluid sampling tool 62. The sample fluid analyzer 504*b* may be operated to analyze and monitor the formation fluid 520 flowing through the sample flowline 92*b*. The formation fluid 520 may exit the fluid sampling tool 62 (e.g., be pumped up the wellbore) as indicated by the upward arrow 530*b* of FIG. 5A. In this configuration, the guard pump 502*a* may not be operated. Thus, there may be no appreciable flow of formation fluid 520 through the guard flowline 92*a*, and the guard fluid analyzer 504*a* may not be operated because there is no appreciable flow of formation fluid 520 through the guard flowline 92*a* to be analyzed. This configuration can also be used for initial clean-up.

In a "split-flow" configuration the flowline bypass valve 509 between the guard and sample flowlines 92*a* and 92*b* may be closed (e.g., to maintain isolation between the formation fluid 520 flowing in the two flowlines 92*a* and 92*b*), and both of the guard pump 502*a* and the sample pump 502*b* may be operated. In such a configuration, the flow of the formation fluid 520 drawn through the primary inlet 512 may not be mixed with the formation fluid 520 drawn through the secondary inlet 514. The formation fluid 520 drawn through the primary inlet 512 (e.g., by operation of the sample pump 502*b*) may be routed through the sample flowline 92*b* such that it passes through the sample fluid analyzer 504*b* before exiting the fluid sampling tool 62. The formation fluid 520 drawn through the secondary inlet 514 (e.g., by operation of the guard pump 502*a*) may be routed through the guard flowline 92*a* such that it passes through the guard fluid analyzer 504*a* before exiting the fluid sampling tool 62. The sample fluid analyzer 504*b* may be operated to analyze and monitor the formation fluid 520 flowing through the sample flowline 92*b*, and the guard fluid analyzer 504*a* may be operated to analyze and monitor the formation fluid 520 flowing through the guard flowline 92*a*. The formation fluid 520 routed through the sample flowline 92*b* may exit the fluid sampling tool 62 (e.g., be pumped up the wellbore) as indicated by the upward arrow 530*b* of FIG. 5A, and the formation fluid 520 routed through the guard flowline 92*a* may exit the fluid sampling tool 62 (e.g., be pumped down the wellbore) as indicated by the downward arrow 530*a* of FIG. 5A. This configuration can also be used for downhole fluid analysis (DFA) (e.g., to determine whether formation fluid is sufficiently low in filtrate contamination), sampling the formation fluid (e.g., to fill the sample bottles 506 with formation fluid 520) and/or initial clean-up. In some instances, a cleanup process is monitored in real-time, using the fluid analyzers 504*a* and 504*b* on both flowlines 92*a* and 92*b*.

In some embodiments, focused-sampling of the formation fluid 520 can be achieved by operating the fluid sampling tool 62 in the three configurations, in the following order: (1) a commingled-down configuration; (2) a commingled-up configuration; and (3) a split-flow configuration. Thus, in a first portion of the sampling process (or a "commingled-down" portion of the sampling process), commingled flow of the formation fluid 520 may be pumped through the guard flowline 92*a* using the guard pump 502*a* while the sample pump 502*b* is idle, as described above. In a second portion of the sampling process (or a "commingled-up" portion of the sampling process), the commingled flow of the formation fluid 520 may be altered and pumped through the sample flowline 92*b* using the sample pump 502*b* while the guard pump 502*a* is idle as described above. These two portions of the sampling process may be used for initial clean-up (e.g., to draw in and remove the mud cake 524 and the filtrate fluid 526 through the fluid sampling tool 62, thereby enabling the virgin formation fluid 528 to be drawn into the fluid sampling tool 62). In a third portion of the sampling process (or "split-flow" portion of the sampling process), the flowline bypass valve 509 may be closed to maintain isolation between the two flowlines 92*a* and 92*b*, and the flow of formation fluid 520 in the two flowlines 92*a* and 92*b* may be independently controlled by the two pumps 502*a* and 502*b*, respectively, as described above. During this third portion of the sampling process, the sample flowline 92*b* may effectively capture the formation fluid 520 concentrated in the central area of the intake 86, while the guard flowline 92*a* may effectively capture the formation fluid 520 concentrated around the perimeter of the intake 86. The formation fluid 520 concentrated in the central area of the intake 86 may primarily include the virgin formation fluid 528, and the formation fluid 520 concentrated around the perimeter of the intake 86 may include the mudcake 524, the filtrate fluid 526 and/or the virgin formation fluid 528. Thus, analyzing and sampling formation fluid flowing through the sample flowline 92*b* may enable a focused analysis and sampling of the virgin formation fluid 528.

In some instances, the timing of transitioning from one configuration to another can be based on the characteristics of the formation fluid 520 being extracted. For example, a pre-breakthrough monitoring process may be conducted to identify a breakthrough of the virgin formation fluid 528, and the split-flow configuration may be initiated in response to detecting, or otherwise identifying, a breakthrough of the virgin formation fluid 528. In such an embodiment, the formation fluid 520 initially drawn into the primary inlet 512 (and through the sample flowline 92*b*) via the split-flow configuration may include a contaminated flow of virgin formation fluid 528 (e.g., virgin formation fluid 528 mixed with the mudcake 524 and/or the filtrate fluid 526). As pumping continues, however, the virgin formation fluid 528 may engulf the primary inlet 512 such that the formation fluid 520 drawn into the primary inlet 512 (and through the sample flowline 92*b*) includes the virgin formation fluid 528 with little to no contamination. In some embodiments, after the split-flow configuration is initiated, a post-breakthrough contamination monitoring process can be conducted on the formation fluid 520 flowing through the sample flowline 92*b* to determine if and when the contamination of the formation fluid 520 has reached a sufficient low level. Once the contamination level is determined to be sufficiently low, additional operations may be conducted, such as a sampling of the formation fluid (e.g., acquiring a sample of the formation fluid 520 in a sample bottle 506), a normalization procedure, and/or the like.

In some embodiments, a breakthrough of the virgin formation fluid 528 can be identified based on a relationship between two or more characteristics (or properties) of the formation fluid 520 exhibiting a linear trend. For example, a breakthrough of the virgin formation fluid 528 can be identified based on a determination that the relationship between optical densities (ODs) of the formation fluid 520 at two different wavelengths exhibits a linear trend over a given period. Although certain embodiments are discussed with regard to optical densities for the purpose of illustration, embodiments may include consideration of any number of and/or combination of characteristics, such as fluid density, resistivity, conductivity, and/or the like. Further, although certain embodiments are discussed with regard to sampling hydrocarbon-based virgin formation fluids (e.g., oil) for the purpose of illustration, the described embodiments may apply to sampling other formation fluids, such as water.

In some instances, contamination monitoring using optical measurements is based on the Beer Lambert law that establishes a linear relationship between the optical absorbance (or "optical density," OD) and the concentrations of species under investigation. For a binary mixture of formation oil and mud filtrate, the measured $OD_\lambda$ at the wavelength $\lambda$ is linearly related to the contamination level by the linear mixing law:

$$OD_\lambda=\eta OD_{\lambda,fil}+(1-\eta)OD_{\lambda,oil} \quad (1)$$

where $OD_{\lambda,fil}$ and $OD_{\lambda,oil}$ are the optical densities of mud filtrate and formation oil at the wavelength $\lambda$, respectively, and $\eta$ is the contamination level in the volume fraction. Assuming that $\eta$ changes with respect to the pumping time or pumping volume, the values of $OD_\lambda$ would reflect the changes in the contamination level of the sampled fluid in front of the optical window.

By taking a particular wavelength channel as the reference channel and another channel at a different wavelength (e.g., the two channels including co-located channels of a spectrometer), the measured optical densities as a function of pumping volume (v) at these two channels can be expressed as:

$$OD_i(v)=\eta(v)OD_{i,fil}+(1-\eta(v))OD_{i,oil} \quad (2)$$

$$OD_{ref}(v)=\eta(v)OD_{ref,fil}+(1-\eta(v))OD_{ref,oil} \quad (3)$$

where ref and i denote the reference channel and the channel at a different wavelength, respectively. By some algebraic manipulation, one can relate these two measurements by $$OD_i(v)=A_i+B_iOD_{ref}(v) \quad (4)$$

where $A_i$ and $B_i$ are two constants, and they depend on the end points $OD_{i,fil}$, $OD_{i,oil}$, $OD_{ref,fil}$, and $OD_{ref,oil}$, then:

$$A_i = \frac{OD_{i,fil}OD_{ref,oil} - OD_{i,oil}OD_{ref,fil}}{OD_{ref,oil} - OD_{ref,fil}}, \tag{5}$$

$$B_i = \frac{OD_{i,oil}OD_{i,fil}}{OD_{ref,oil} - OD_{ref,fil}}. \tag{6}$$

Equation (4) indicates that the cross-plots of optical density data of the reference channel with the optical density data of other channels should exhibit linear trends with offset $A_i$ and slope $B_i$.

Similarly, a densimeter (e.g., a sensor for measuring fluid density) co-located with the optical spectrometer along the flowline measures the fluid density of the same binary mixture of formation oil and mud filtrate. The measured fluid density of the fluid mixture is also linearly related to the fluid density of uncontaminated formation oil ($\rho_{oil}$) and the fluid density of filtrate ($\rho_{fil}$) by:

$$\rho(v)=\eta(v)\rho_{fil}+(1-\eta)(v))\rho_{oil}, \tag{7}$$

where $\rho(v)$ is the measured fluid density and $\eta(v)$ is the contamination level in the volume fraction. Based on Equations (1) and (7), the following relationship between the density (p) and optical measurements ($OD_\lambda$) can be derived:

$$OD_\lambda(v)=A+B\rho(v) \tag{8}$$

where A and B are two constants defined as:

$$A = \frac{OD_{\lambda,fil}\rho_{oil} - OD_{\lambda,oil}\rho_{fil}}{\rho_{oil} - \rho_{fil}} \tag{9}$$

$$B = \frac{OD_{\lambda,oil} - OD_{\lambda,fil}}{\rho_{oil} - \rho_{fil}} \tag{10}$$

Equation (4) or Equation (8), or a combination of both, can be used to identify the breakthrough of formation fluid. The breakthrough may be characterized by the apex as the mixture of formation fluid and mud filtrate reaches and enters the probe and flowline. Filtrate contamination may be further reduced with continued pumping. Equation (4) and Equation (8) represent that the cross-plots of OD channels (OD-vs-OD) or the cross-plot of OD and fluid density (OD-vs-density) will exhibit linear trends as pumping continues and filtrate contamination progressively reduces. Therefore, the breakthrough can be detected by identifying the earliest time when the linear trends are established while pumping. That is, the breakthrough can be identified to be the start of the linear trends exhibited while pumping.

Similar relationships can also be extended for identifying breakthrough in water sampling operations. In water sampling, the resistivity cell can be used to measure fluid resistivity along a flowline. The inverse of resistivity (conductivity) can also follow a mixing law similar to that of Equations (1) and (7):

$$\frac{1}{R} = \eta(v)\frac{1}{R_{fil}} + (1-\eta(v))\frac{1}{R_{wtr}}, \tag{11}$$

where R is the measured resistivity by the resistivity cell, $R_{fil}$ is the resistivity of invaded fluid from WBM, and $R_{wtr}$ is the formation water resistivity. With the co-located resistivity cell and densimeter, the cross-plot of measured fluid conductivity and fluid density may exhibit a linear trend similar to that for hydrocarbons, and this linear trend can be used in a similar manner to identify the miscible formation water breakthrough in water sampling.

Figure 6A:
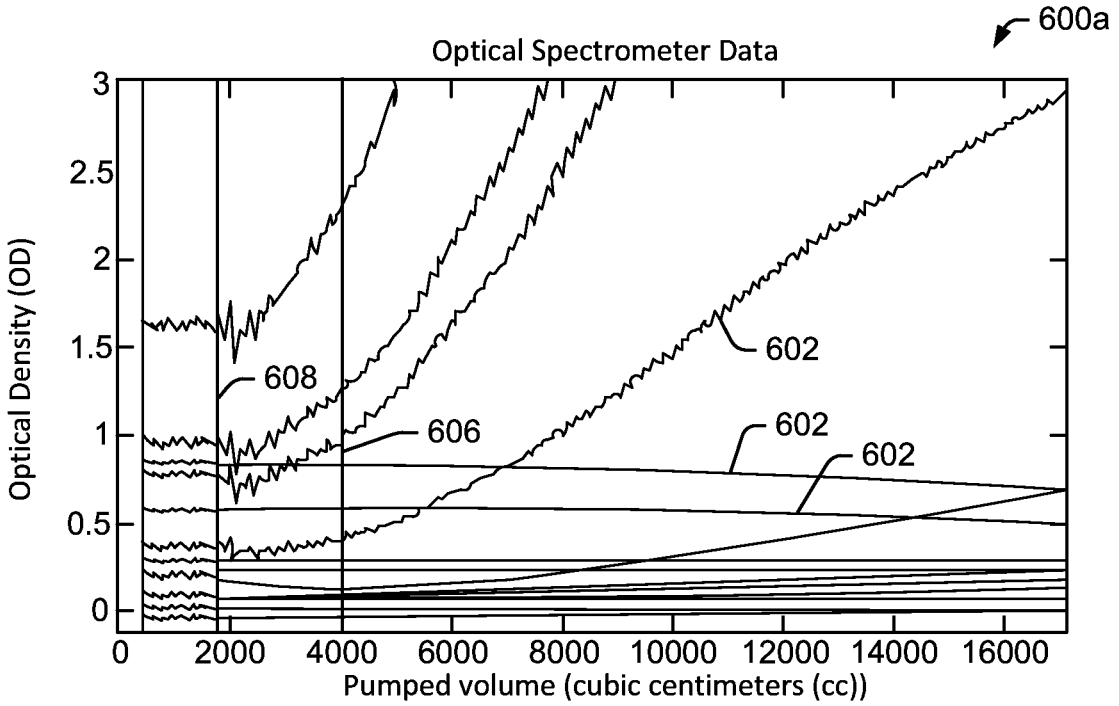
FIG. 6A is a chart diagram illustrating example multichannel optical density data in accordance with one or more embodiments.
Figure 6B:
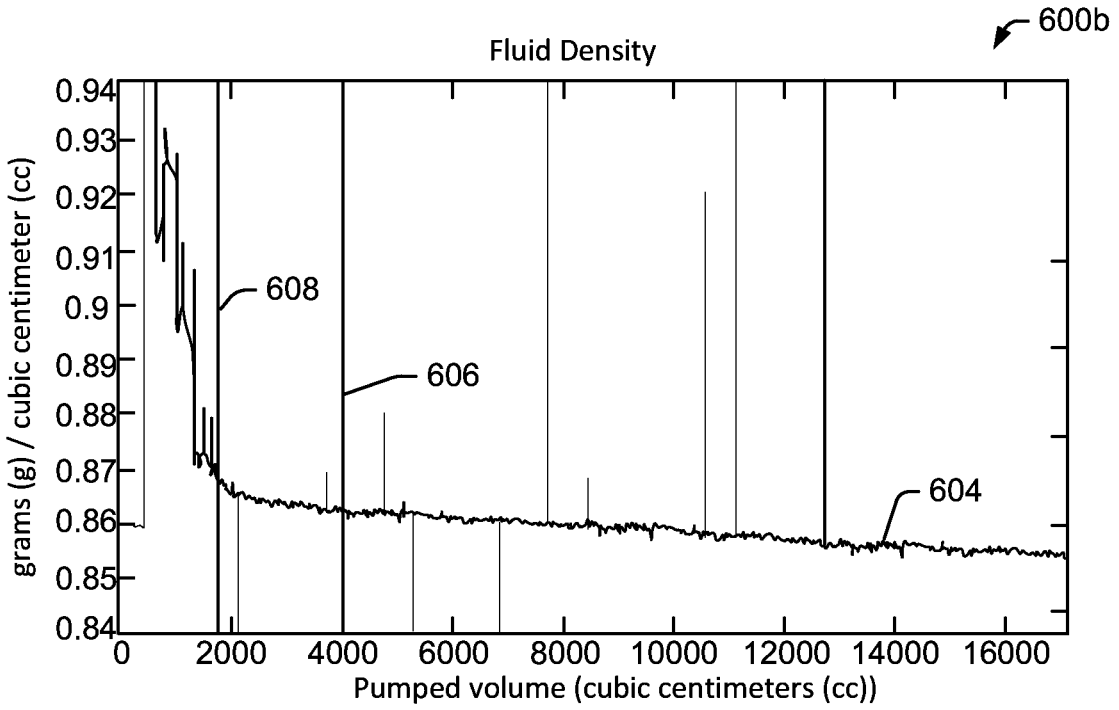
FIG. 6B is a chart diagram illustrating example fluid density data in accordance with one or more embodiments.

FIGS. 6A, 6B and 7A-7E may help to illustrate the cross-plotting of data and the detection of breakthrough based on the linear trends established while pumping. FIG. 6A is a chart diagram 600*a* illustrating example multi-channel optical density data in accordance with one or more embodiments. FIG. 6B is a chart diagram 600*b* illustrating example fluid density data in accordance with one or more embodiments. FIGS. 7A-7E are example cross-plot diagrams 700*a*-700*e* illustrating relationships between characteristics (or properties) of formation fluid in accordance with one or more embodiments.

Referring first to FIGS. 6A and 6B, the charts 600*a* and 600*b* may be generated based on a set of in-situ data. These charts 600*a* and 600*b* may be displayed in a graphical user interface (GUI), for example, for viewing by an operator. The optical density chart 600*a* of FIG. 6A may represent a multi-channel optical density (y-axis) acquired by in-situ fluid analyzer (IFA) versus a pumped volume of formation fluid (x-axis). The optical density chart 600*a* may include a plot 602 of a determined optical density for each of a plurality of channels being monitored. Each of the plots 602 for the respective channels may represent an optical density measurement (at a different wavelength) of the formation fluid 520 being pumped through the fluid sampling tool 62 at a given time. That is, each channel, and thus each plot, may be based on an optical density measurement at a different wavelength taken by a spectrometer. Each of the channels may measure optical density at different wavelengths in the range of about 400-2000 nanometers (nm). The fluid density chart 600*b* of FIG. 6B may be generated based on a set of in-situ fluid density data. The fluid density chart 600*b* of FIG. 6B may include a fluid density plot 604 that represents the fluid density data (y-axis) versus the pumped volume of formation fluid (x-axis). The fluid density data may be acquired via a densimeter that is co-located or located nearby the spectrometer. As will be discussed in further detail below, the vertical line 606 at a volume of approximately 4000 cc may represent the point at which breakthrough occurs, and the vertical line 608 at a volume of approximately 2000 cc may represent a point shortly before breakthrough occurs. These lines may be time/volume aligned with corresponding points on the cross-plots 702*a*-702*e* of FIGS. 7A-7E.

Referring now to FIGS. 7A-7D, each of the cross-plot diagrams 700*a*-700*d* illustrate a cross-plot 702*a*-702*d* of optical density measured by a first channel versus optical density measured by a second channel across a given duration (e.g., a time or pumped volume of about 18000 cubic centimeters (cc) as indicated by the x-axis of FIGS. 6A and 6B). These cross-plot (e.g., cross-plots 702*a*-702*d*) may be displayed in a graphical user interface (GUI), for example, for viewing by an operator. Each point of the cross-plots 702*a*-702*d* may include an x-axis value representing an optical density (OD) at a first wavelength (e.g., measured by a first channel) at a given time (e.g., at a given pumped volume), and a y-axis value representing an optical density (OD) at a second wavelength (e.g., measured by a second channel) at the same time (e.g., at the same pumped volume). The optical density measurements may be acquired via a spectrometer with multiple wavelength channels.

Each of the cross-plots 702*a*-702*d* includes a first portion that does not exhibit a linear trend of any regularity (e.g., a non-linear portion 704) and a second portion that exhibits a linear trend (e.g., a linear portion 706). Notably, the linear portion 706 begins at or near a breakthrough point 708 that corresponds to a pumped volume of approximately 4000 cc (e.g., the location of the vertical line 606 in the charts 600*a* and 600*b* of FIGS. 6A and 6B). The linear trends exhibited by the cross-plots 702*a*-702*d* may be consistent with the linear trend predicted by Equation (4). The cross-plots 702*a*-702*d* illustrate a deviation from a linear trend at the beginning of pumping operation, which may be caused by the presence of mud cake debris, sand particles, gas bubbles, etc., in the flowline, followed by the establishment of a linear trend once the breakthrough occurs and pumping progresses. Notably, the linear trend may include a build-up trend (e.g., as illustrated by the positive sloping linear trend portion 706 of the cross-plots 702*a*-702*c* of FIGS. 7A-7C), or a build-down trend (e.g., as illustrated by the negative sloping linear trend portion 706 of the cross-plot 702*d* of FIG. 7D).

Figure 7A:
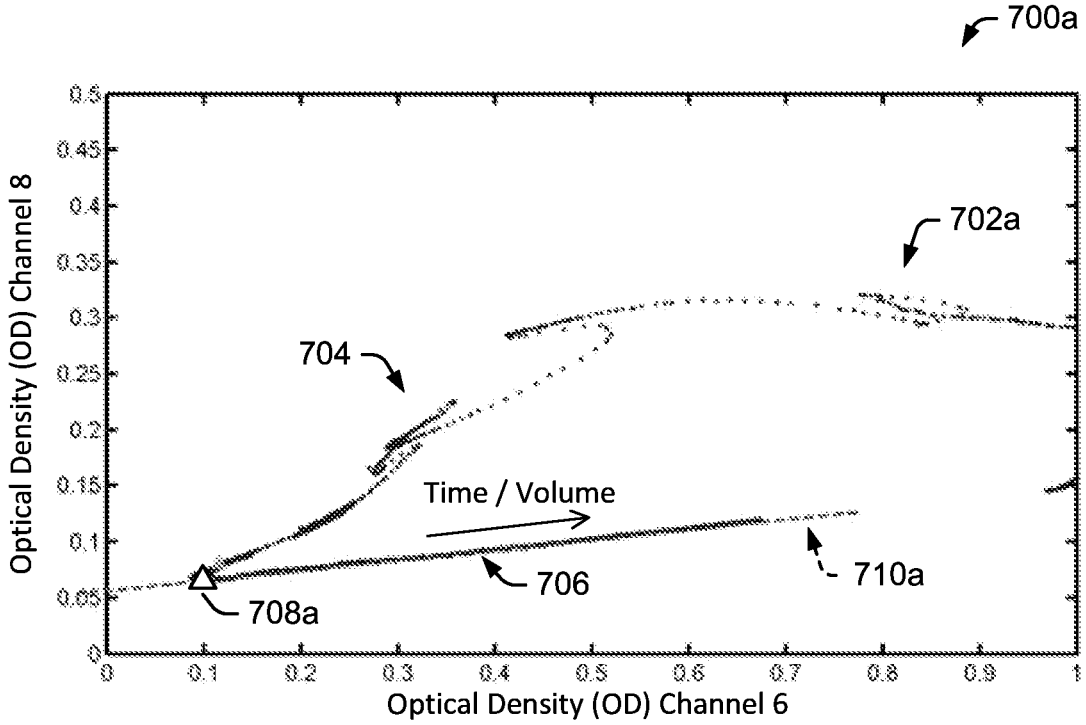
FIGS. 7A-7E are example cross-plot diagrams illustrating relationships between characteristics of formation fluid in accordance with one or more embodiments.
Figure 7B:
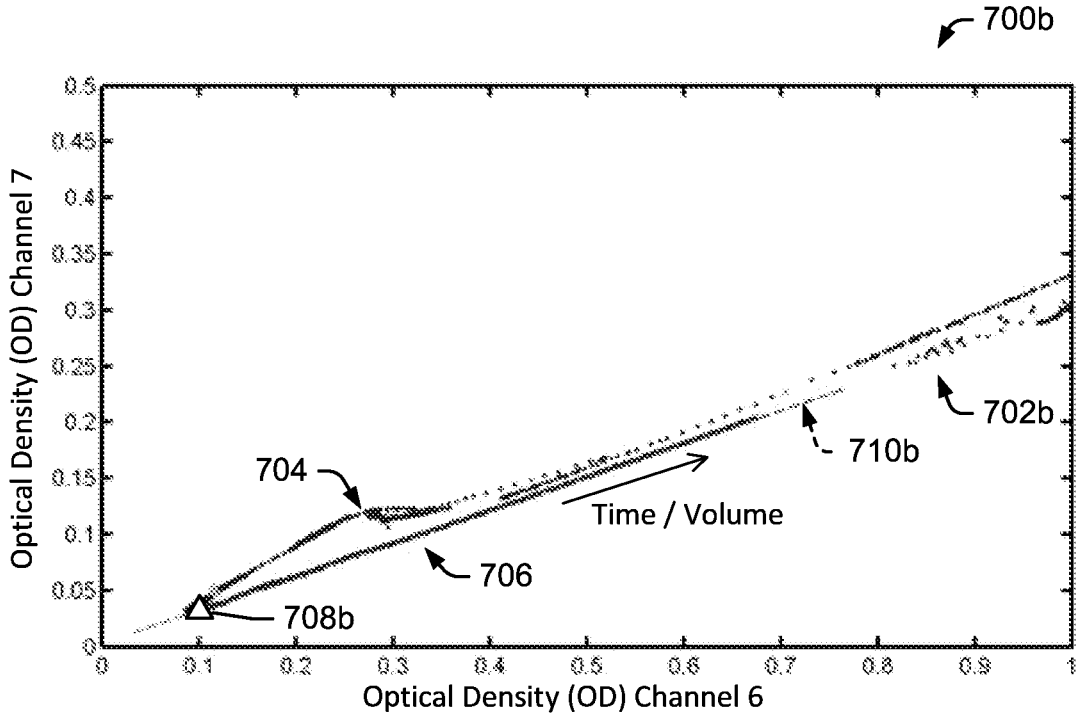
Figure 7C:
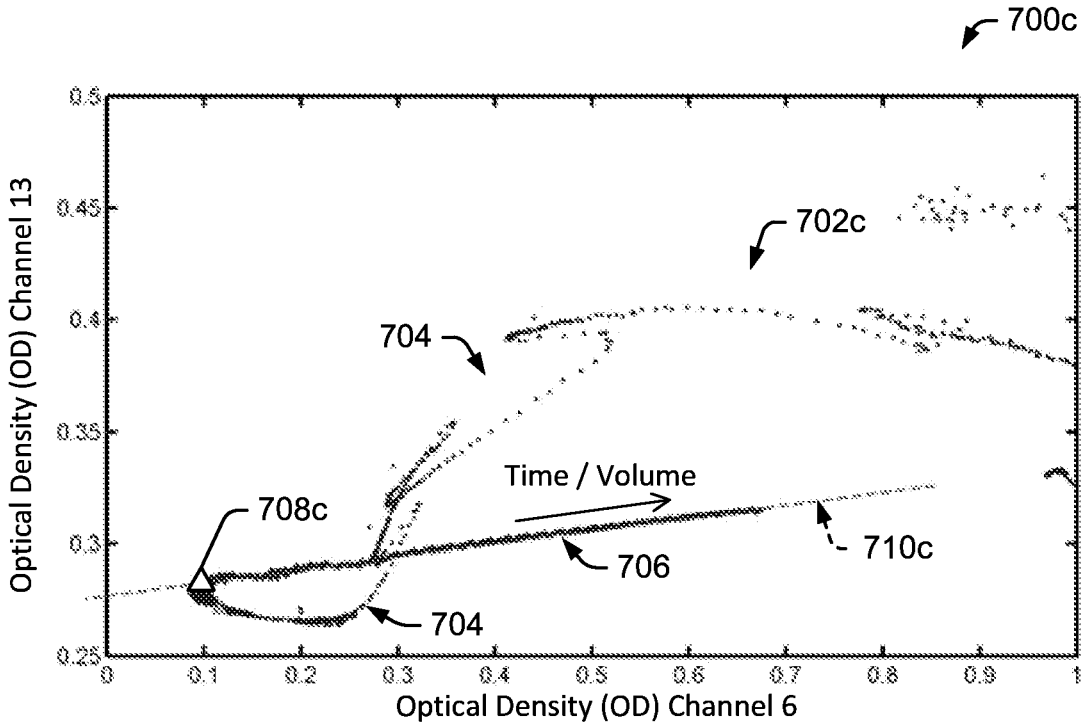
Figure 7D:
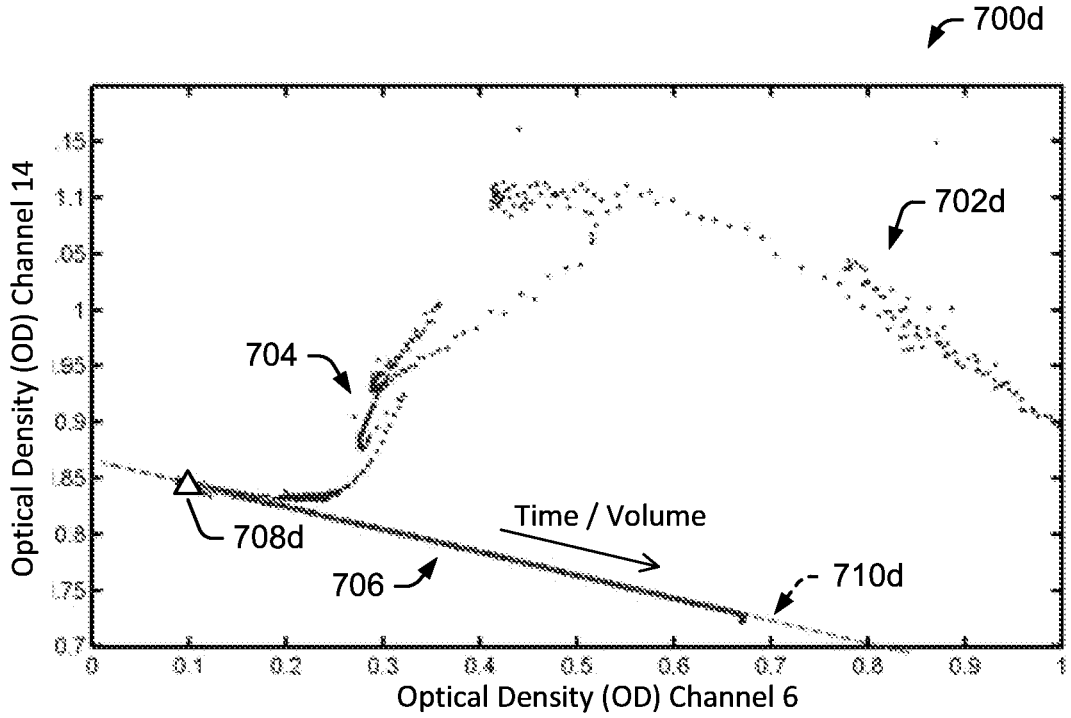
Figure 7E:
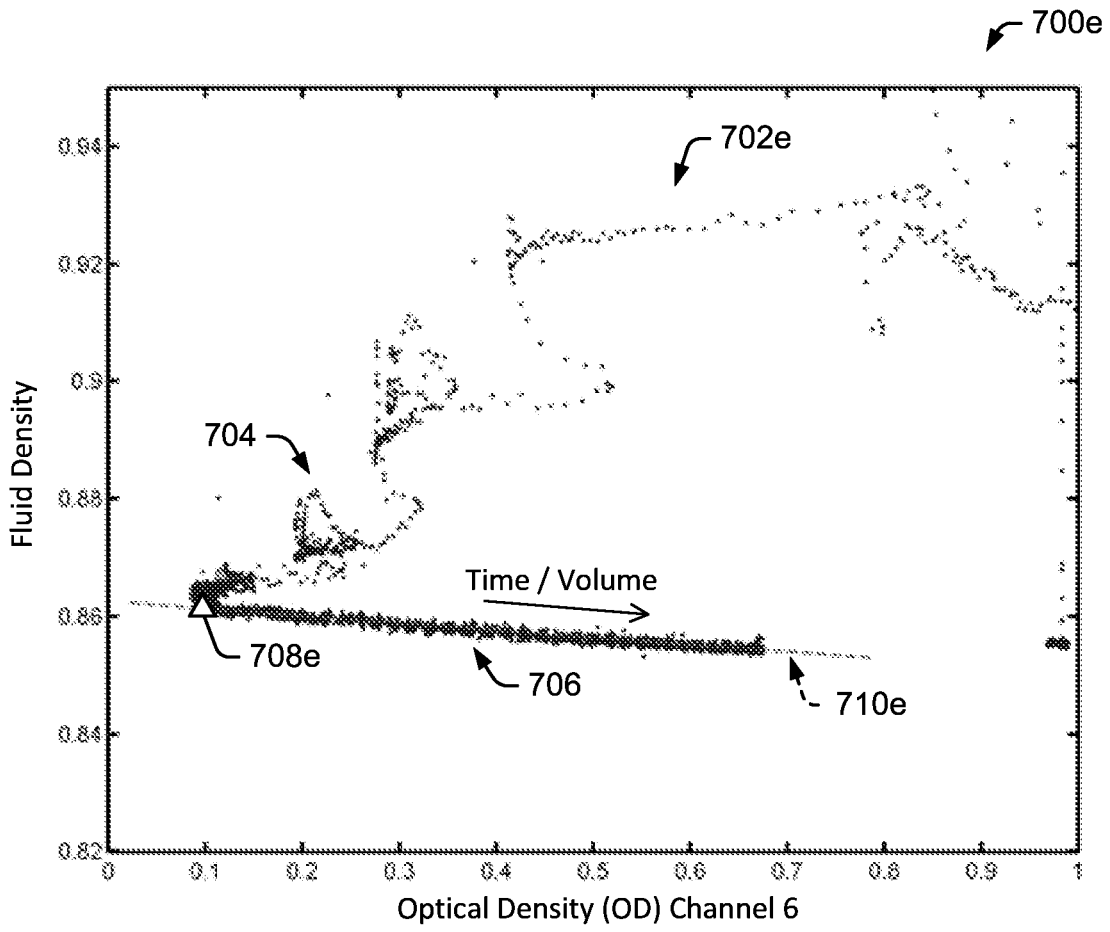

Referring to FIG. 7E, the cross-plot diagram 700*e* may illustrate a cross-plot 702*e* of fluid density versus the optical density measured across a given duration (e.g., time or pumped volume of about 18000 cubic centimeters (cc)). Each point of the plot 702*e* may include an x-axis value representing an optical density (OD) at a given wavelength (e.g., measured by a channel of a spectrometer) at a given time (e.g., at a given pumped volume), and a y-axis value representing the fluid density (ρ) of the formation fluid at the same time (e.g., at the same pumped volume). Similar to the cross-plots 702*a*-702*d* of FIGS. 7A-7D, the cross-plot 702*e* of FIG. 7E includes a first portion that does not exhibit a linear trend of any regularity (e.g., a non-linear portion 704) and a second portion that exhibits a linear trend (e.g., a linear portion 706). Notably, the linear portion 706 begins at or near a point that corresponds to a pumped volume of approximately 4000 (e.g., the location of the vertical line 606 in the charts 600*a* and 600*b* of FIGS. 6A and 6B). The linear trend exhibited by the cross-plot 702*e* is consistent with the linear trend predicted by Equation (8). Furthermore, the breakthrough detected using the cross-plot 702*e* is consistent with the breakthrough detected using the cross-plots 702*a*-702*d* shown previously. The cross-plot 702*e* illustrates a deviation from a linear trend at the beginning of the pumping operation, which may be caused by the presence of mud cake debris, sand particles, gas bubbles, etc., in the flowline, followed by the establishment of a linear trend once the breakthrough occurs and pumping progresses. Notably, the linear trend may include a build-up trend (e.g., as illustrated by a positive sloping linear trend portion 706), or a build-down trend (e.g., as illustrated by the negative sloping linear trend portion 706 of the cross-plot 702*e* of FIG. 7E).

In accordance with the present disclosure, the systems described can be used to perform focused sampling of formation fluid shortly after breakthrough of the formation fluid. For example, the systems described may be used to: (1) extract formation fluid through a focused sampling tool having a guard and a sample flowline; (2) conduct pre-breakthrough monitoring of the extracted formation fluid to identify if and when a breakthrough of the reservoir fluid occurs (e.g., including identifying the breakthrough based at least in part on the identification of a linear trend exhibited by a relationship between monitored characteristics (or properties) of the extracted formation fluid, such as optical density, fluid density, resistivity, conductivity, and/or the like); (3) split the flow of the extracted fluid into sample and guard flowlines at, near, or shortly after the identified breakthrough; (4) conduct post-breakthrough contamination monitoring of the extracted formation fluid flowing through the sample line to determine if and when its contamination level is sufficiently low; and/or (5) acquire a sample of the formation fluid while the contamination level is sufficiently low.

Figure 8:
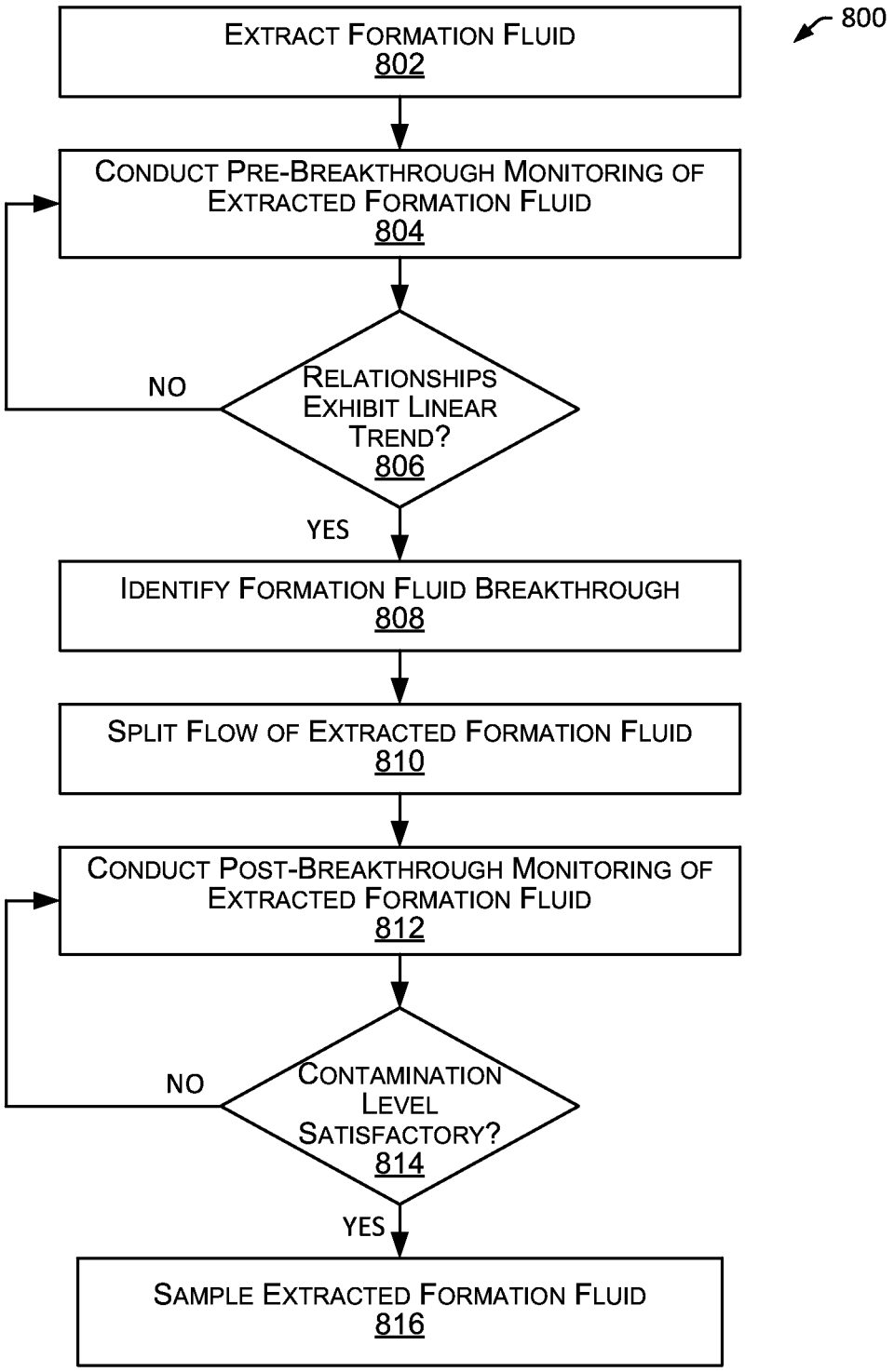
FIG. 8 is a flowchart that illustrates an example method for focused fluid sampling in accordance with one or more embodiments.

FIG. 8 is a flowchart that illustrates a method 800 for focused fluid sampling in accordance with one or more embodiments. The method 800 may generally include extracting formation fluid from a formation (block 802), conducting pre-breakthrough monitoring of the extracted formation fluid (e.g., monitoring one or more relationships between the characteristics of the extracted formation fluid) (block 804), determining whether one or more of the monitored relationships between characteristics (or properties) of the extracted formation fluid exhibit a linear trend (block 806) (e.g., based on the pre-breakthrough monitoring of the extracted formation fluid). In response to determining that the monitored relationships do not exhibit a linear trend (block 806), the pre-breakthrough monitoring of the extracted formation fluid (block 804) may continue to be performed. In response to determining that the one or more monitored relationships do exhibit a linear trend (block 806), however, the method 800 may proceed to identifying a formation fluid breakthrough (block 808) (e.g., based on the linear trend exhibited), and performing operations (or actions) consistent with a reservoir fluid breakthrough. These "post-breakthrough" operations may include, for example, splitting the flow of the extracted formation fluid in the fluid sampling tool (block 810) (e.g., such that portions of the flow of the extracted formation fluid are simultaneously directed through the sample flowline 92*b* and the guard flowline 92*a*), conducting post-breakthrough monitoring of the extracted formation fluid (e.g., conducting contamination monitoring of the extracted formation fluid in the sample flowline 92*b*) (block 812), and/or determining whether the extracted formation fluid is of a satisfactory contamination level (block 814) (e.g., based on the post-breakthrough monitoring of the extracted formation fluid). In response to determining that the extracted formation fluid is not of a satisfactory contamination level (block 814), the post-breakthrough monitoring of the extracted formation fluid (block 812) may continue to be performed. In response to determining that the extracted formation fluid is of a satisfactory contamination level (block 814) (e.g., determining that the contamination level of the extracted formation fluid flowing through the sample flow line 92*b* is at or below a threshold contamination level), the method 800 may proceed to performing additional operations (or actions) consistent with a satisfactory contamination level, such as sampling the extracted formation fluid (block 816). In some embodiments, some or all of the aspects of the method 800 can be performed, or otherwise controlled by, controller 100 and/or monitoring and control 66.

In some embodiments, extracting formation fluid from a formation (block 802) can include employing a fluid sampling tool 62 to extract formation fluid from a formation. For example, referring to the fluid sampling tool of FIGS. 5A and 5B, extracting formation fluid 520 from the formation 49 may include the probe module 70 extending the focused sampling probe 82 of the focused fluid sampling tool 62 into engagement with the wall 84 of the formation 49, as depicted, and operating at least one of the guard and sample pumps 502*a* and 502*b* to draw the formation fluid 520 from the formation 49 and into at least one of the guard and sample flowlines 92*a* and 92*b* via the intake 86. Extracting formation fluid 520 from the formation 49 may include continued pumping to generate a continued flow of formation fluid 520 through at least one of the guard and sample flowlines 92*a* and 92*b*. Thus, extracting formation fluid 520 from the formation 49 may include generating a flow of formation fluid 520 through one or both of the guard and sample fluid analyzers 504*a* and 504*b*. In some embodiments, this initial stage of formation fluid extraction includes operating the fluid sampling tool 62 in a commingled-down and/or commingled-up configuration. For example, extracting formation fluid 520 from the formation 49 may include, first, operating the fluid sampling tool 62 in a commingled-down configuration and then operating the fluid sampling tool 62 in a commingled-up configuration. In some embodiments, the fluid sampling tool 62 can be operated in the commingled-up configuration until the fluid sampling tool 62 is shifted into a split-flow configuration as a result of identifying a breakthrough of a reservoir fluid, as described below.

In some embodiments, conducting pre-breakthrough monitoring of the extracted formation fluid (block 804) includes monitoring one or more relationships between the characteristics (or properties) of the extracted formation fluid to determine whether one or more of the relationships exhibit a linear trend (block 806). In some embodiments, the monitored characteristics may include optical density fluid density, resistivity, conductivity and/or the like. For example, with regard to hydrocarbon sampling and, thus, monitoring the formation fluid 520 for a hydrocarbon-based reservoir fluid (e.g., oil), conducting pre-breakthrough monitoring of the extracted formation fluid 520 may include monitoring one or more relationships between an optical density of the formation fluid 520 at a first wavelength and the optical density of the formation fluid 520 at a second wavelength. Such a relationship may be established and monitored for a variety of combinations of optical density measurements at different wavelengths (e.g., as illustrated by the cross-plot diagrams 700*a*-700*d* of FIGS. 7A-7D). As a further example, with regard to hydrocarbon sampling (e.g., oil sampling) and, thus, monitoring the formation fluid for 520 a hydrocarbon-based reservoir fluid (e.g., oil), conducting pre-breakthrough monitoring of the extracted formation fluid 520 may include monitoring one or more relationships between the optical density of the formation fluid 520 at a given wavelength and the fluid density of the formation fluid 520 (e.g., as illustrated by the cross-plot diagram 700*e* of FIG. 7E). Such a relationship may be established and monitored for a variety of combinations of optical density measurements at different wavelengths and a corresponding fluid density measurement of the formation fluid 520.

In some embodiments, conducting pre-breakthrough monitoring of the extracted formation fluid includes monitoring one or more relationships between the characteristics (or properties) of the extracted formation fluid in real-time to determine whether one or more of the relationships exhibit a linear trend. For example, the monitoring may include acquiring real-time downhole data from the logging tool 62, identifying, in real-time and using the downhole data, the relationships between characteristics of the formation fluid 520 extracted from the formation 49, and displaying or otherwise presenting, in real-time and in a graphical user interface, one or more cross-plots of the relationships between the monitored characteristics of the formation fluid 520. Such real-time data acquisition may include sending or otherwise providing the data to a processing unit shortly after it is acquired (e.g., transmitting the data to a monitoring and control 66, e.g., via wireline, mud-pulse telemetry and/or the like, within second or minutes after it is acquired). Such real-time presentation of the cross-plots may include displaying the cross-plots (or otherwise providing data indicative of the relationships between the characteristics) shortly after the data used to generate the cross-plots (or the relationships) is acquired (e.g., generating and displaying the cross-plots within second or minutes of the corresponding data being acquired downhole). Such real-time monitoring can enable a system or operator to make operational decisions in real-time. For example, monitoring and control 66 and/or an operator may be able to initiate a split-flow configuration of the tool 62 within seconds or minutes of a breakthrough condition based on the relationships between the characteristics being provided within seconds or minutes of acquiring downhole data that is indicative of a breakthrough condition.

With regard to water sampling and, thus, monitoring the formation fluid 520 for a water-based reservoir fluid (e.g., formation connate water), conducting pre-breakthrough monitoring of the extracted formation fluid 520 may include monitoring a relationship between the conductivity and the fluid density of the formation fluid 520. As a further example, with regard to water sampling and, thus, monitoring the formation fluid 520 for a water-based reservoir fluid (e.g., formation connate water), if dye is added to the drilling mud such that dyed water from the drilling mud is mixed into the formation fluid 520, then conducting pre-breakthrough monitoring of the extracted formation fluid 520 may include monitoring one or more relationships between an optical density of the formation fluid 520 at a first wavelength and the optical density of the formation fluid 520 at a second wavelength, and/or monitoring one or more relationships between the optical density of the formation fluid 520 at a given wavelength, the fluid density of the formation fluid 520 and/or conductivity of formation fluid 520.

In some embodiments, the characteristics (or properties) of the formation fluid 520 are determined based on measurements acquired by at least one of the guard and sample fluid analyzers 504*a* and 504*b*. For example, during operation of the fluid sampling tool 62 in a commingled-down configuration, the optical densities, the fluid density, and/or the resistivity (or conductivity) of the formation fluid 520 may be determined based on measurements acquired via corresponding co-located sensors of the guard fluid analyzer 504*a*. During operation of the fluid sampling tool 62 in a commingled-up configuration, the optical densities, the fluid density, and/or the resistivity (or conductivity) of the formation fluid 520 may be determined based on measurements acquired via corresponding co-located sensors of the sample fluid analyzer 504*b*. In some embodiments, the measurements may include optical densities for each of the wavelengths for which a relationship is established. For example, if the relationships include relationships between optical densities measured at 20 different wavelengths, then each of the guard and sample fluid analyzers 504*a* and 504*b* may have 20 channels, with each of the channels capable of acquiring a live optical density measurement at a respective one of the 20 different wavelengths. Thus, for example, each of the guard and sample fluid analyzers 504*a* and 504*b* may include 20 different spectrometer sensors, each acquiring measurements at one of the 20 different wavelengths. Further, the fluid analyzers 504*a* and 504*b* may each include a densimeter that is capable of acquiring a live fluid density measurement of the formation fluid 520. The sensors of the fluid analyzers 504*a* and 504*b* may be co-located. For example, the spectrometer(s) and the densimeter of the sample fluid analyzer 504*b* may be co-located with one another, and the spectrometer(s) and the densimeter of the guard fluid analyzer 504*a* may be co-located with one another. Optical density channels of a sample spectrometer which examines fluid through an optical window of the sample spectrometer may be considered co-located. Other sensors, such as the density or resistivity sensors, may be co-located if they are proximate or nearby one another (e.g., within about 0-7 cm on the flowline). For example, a densimeter may be co-located with channels of a spectrometer if the densimeter is within about 7 cm of the spectrometer (e.g., they are located within about 7 cm of one another on a flowline for which they are used to measure formation fluid 520 flowing there through). Such co-location may include any relative positioning such that the measurements taken at or about the same time are taken across substantially the same formation fluid 520.

In some embodiments, conducting pre-breakthrough monitoring of the extracted formation fluid 520 can include determining whether one or more of the monitored relationships exhibit a linear trend indicative of a reservoir fluid breakthrough (e.g., a breakthrough of virgin formation fluid 528 from the formation 49). For example, with regard to monitoring the relationships between optical densities at different wavelengths as depicted in the cross-plot diagrams 700*a*-700*d* of FIGS. 7A-7D, and/or monitoring the relationship between optical density and fluid density of the formation fluid 520 depicted in the cross-plot diagram 700*e* of FIG. 7E, it can be determined that each of the relationships exhibits a linear trend with regard to the plotted points following the respective breakthrough points 708*a*-708*e* of FIGS. 7A-7E (e.g., that correspond to the location of the vertical line 606 in the charts 600*a* and 600*b* of FIGS. 6A and 6B and pumped volume of approximately 4000 cubic centimeters (cc)). In some embodiments, it may be determined that the formation fluid 520 exhibits a linear trend indicative of a reservoir fluid breakthrough if at least a threshold amount (e.g., a threshold number or percentage) of the relationships being monitored are determined to exhibit a linear trend. The threshold may include, for example, at least one of the monitored relationships exhibiting a linear trend, multiple but less than all of the monitored relationships exhibiting a linear trend (e.g., 25%, 50%, or 75% of the monitored relationships exhibiting a linear trend), or all of the relationships exhibiting a linear trend (e.g., 100% of the monitored relationships).

In some embodiments, determining whether one or more of the monitored relationships exhibit a linear trend indicative of reservoir fluid breakthrough can include determining whether one or more of the monitored relationships exhibit a linear trend over a given duration. For example, determining whether one or more of the monitored relationships exhibit a linear trend indicative of a reservoir fluid breakthrough can include determining whether one or more of the monitored relationships exhibit a linear trend over a given length of time (e.g., over the last 2 minutes) or over a given volume of pumping (e.g., over the last 2000 cubic centimeters for formation fluid flow). In some embodiments, a linear trend can be established by performing a cure fitting or a line fitting over the specified duration. For example, a linear trend may be identified when a least-squares line fitting over the specified duration has a total error (or deviation) below a specified threshold. Such a technique may help to eliminate prematurely identifying a linear trend in the monitored relationship. The line fitting for each of the cross-plot diagrams 700*a*-700*e* of FIGS. 7A-7E may be represented by fit-lines 710*a*-710*e* of the respective diagrams. In some embodiments, if it is determined that the monitored relationships do not exhibit a linear trend indicative of reservoir fluid breakthrough (block 806), the method 800 may include continuing to conduct pre-breakthrough monitoring of the extracted formation fluid (block 804). In some embodiments, a linear trend may be identified, for example, by visual inspection. For example, an operator may identify a linear trend via inspection of one or more of the cross-plot diagrams 700*a*-700*e* of FIGS. 7A-7E (e.g., displayed in a GUI).

In some embodiments, identifying a reservoir fluid breakthrough can include identifying a breakthrough point that corresponds to a point at or near the start of the linear trend or trends identified. For example, with regard to the cross-plots 702*a*-702*e* of FIGS. 7A-7E, identifying a reservoir fluid breakthrough may include identifying a breakthrough point at the pumped volume of approximately 4000 cubic centimeters (cc)—this point may correspond to the respective breakthrough points 708*a*-708*e* of the cross-plots 702*a*-702*e* (e.g., that correspond to the location of the vertical line 608 in the charts 600*a* and 600*b* of FIGS. 6A and 6B and pumped volume of approximately 4000 cubic centimeters (cc)). In some embodiments, if multiple linear trends are identified, the breakthrough point may be a point corresponding to an average starting point for some or all of the identified linear trends. Thus, for example, if each of the respective breakthrough points 708*a*-708*e* of FIGS. 7A-7E is slightly different, the breakthrough point may correspond to an average of the time and/or pumped volume corresponding to the breakthrough points 708*a*-708*e*. In some embodiments, the breakthrough point may correspond to the latest or most recent breakthrough time identified for all of the cross-plots 702*a*-702*e*. Thus, multiple relationships derived from measurements across multiple channels and sensors may be employed to identify a reservoir fluid breakthrough.

In some embodiments, splitting the flow of the extracted formation fluid in the fluid sampling tool (block 810) includes operating the fluid sampling tool 62 in a "split-flow" configuration. Thus, splitting the flow of the extracted formation fluid may include operating both of the guard and sample pumps 502*a* and 502*b* to generate a flow of the formation fluid 520 through both of the guard and sample flowlines 92*a* and 92*b* and, thus, through both of the guard and sample fluid analyzers 504*a* and 504*b*.

In some embodiments, conducting post-breakthrough monitoring of the extracted formation fluid (block 812) includes conducting contamination monitoring of the extracted formation fluid 520 flowing through the sample flowline 92*b* to determine whether the extracted formation fluid 520 flowing through the sample flowline 92*b* is of a satisfactory contamination level (block 814). For example, conducting post-breakthrough monitoring of the extracted formation fluid may include determining a contamination level of the extracted formation fluid 520 flowing through the sample flowline 92*b* and comparing the contamination level to a specified threshold contamination level. In some embodiments, it may be determined that the formation fluid 520 is of a satisfactory contamination level if the contamination level is at or below the specified threshold contamination level. It may be determined that the formation fluid 520 is not of a satisfactory contamination level if the contamination level is above the specified threshold contamination level. Thus, conducting post-breakthrough monitoring of the extracted formation fluid 520 may include determining whether the contamination level of the extracted formation fluid 520 flowing through the sample flowline 92*b* is sufficiently low. In some embodiments, the contamination level may be determined based on a measured optical density of the formation fluid 520. The contamination level of the extracted formation fluid 520 flowing through the sample flowline 92*b* may be determined to be sufficiently low if, for example, the optical density of the extracted formation fluid 520 is below a threshold level and/or has reached a stable value (or a steady state value). Although certain embodiments, are described in the context of focused sampling operations (e.g., including splitting the flow of formation fluid) for the purpose of illustration, similar techniques can be employed with other operations, such as non-focused sampling operations (e.g., contamination monitoring and/or sampling operation that do not employ a splitting the flow of formation fluid). For example, conducting post-breakthrough monitoring of the extracted formation fluid may include conducting non-focused sampling operations (e.g., including conducting contamination monitoring and/or sampling operations without splitting the flow of formation fluid).

In some embodiments, conducting post-breakthrough monitoring of the extracted formation fluid includes performing normalization for the extracted formation fluid. The normalization may include selecting an interval that occurs after the point of the determined formation fluid breakthrough, and conducting a normalization procedure using data or measurements corresponding to the selected interval. Such a normalization process may ensure that normalization is performed using measurements of the formation fluid 520 that are acquired post-breakthrough. The detection of breakthrough may enable identifying the time or volume interval of data (e.g., optical density data) over which the normalization procedure is applied. The normalization procedure can be part of multi-channel contamination algorithm which produces the contamination level estimate.

Because continued pumping in the split-flow configuration should eventually result in virgin formation fluid 528 engulfing the primary inlet 512 of the fluid sampling tool 62 as discussed above, and the post-breakthrough monitoring of the extracted formation fluid 520 may ensure that the formation fluid 520 is sufficiently free of contaminants before taking a sample, it is expected that a sample of the formation fluid 520 acquired when the contamination level is sufficiently low should include virgin formation fluid 528 that is sufficiently free of contaminants. In some embodiments, if it is determined that the formation fluid 520 is not of a satisfactory contamination level (block 814), the method 800 may include continuing to conduct post-breakthrough monitoring of the extracted formation fluid (block 812). As discussed herein, the method 800 may include, in response to determining that the contamination level is of a satisfactory level, performing additional actions consistent with a satisfactory contamination level, such as sampling the extracted formation fluid (block 816).

In some embodiments, sampling the extracted formation fluid (block 816) can include acquiring a physical sample of the formation fluid. For example, referring to FIG. 5B, sampling the extracted formation fluid 520 may include opening the sample valve 508 to divert, into one or more sample bottles 506, at least a portion of the formation fluid 520 flowing through the sample flowline 92*b*. As described herein, the acquired sample of the formation fluid 520 can be returned to the surface and further analyzed to determine characteristics of the formation fluid 520, characteristics of the virgin formation fluid 528, characteristics of the formation 49, characteristics of the well 14, and/or the like.

It will be appreciated that the method 800 is an embodiment of a method that may be employed in accordance with the techniques described herein. The method 800 may be modified to facilitate variations of its implementation and use. The order of the method 800 and the operations provided therein may be changed, and various elements may be added, reordered, combined, omitted, modified, etc. Portions of the method 800 may be implemented in software, hardware, or a combination thereof. Some or all of the portions of the method 800 may be implemented by one or more of the processors/modules/applications.

Although certain embodiments relate to use of certain fluid characteristics such as optical density, fluid density, and resistivity (or conductivity) for the purpose of illustration, the techniques can be extended to any variety of fluid characteristics. For example, the sensors may include optical spectrometers, fluid density sensors, resistivity sensors, viscosity sensors, nuclear magnetic resonance (NMR) sensors, dielectric sensors, ultrasonic sensors, and/or the like. The derived fluid characteristics (or properties) may include gas-to-oil ratio (GOR), compressibility, fluid composition, saturation pressure (e.g., bubble point, dew point, asphaltene onset pressure), refractivity, thermal conductivity, heat capacity, and/or the like. The relationships may include relationships between these fluid characteristics (or properties).

Further modifications and alternative embodiments of various aspects of the disclosure will be apparent to those skilled in the art in view of this description. Accordingly, this description is to be construed as illustrative and is for the purpose of teaching those skilled in the art the general manner of carrying out the disclosure. It is to be understood that the forms of the disclosure shown and described herein are to be taken as examples of embodiments. Elements and materials may be substituted for those illustrated and described herein, parts and processes may be reversed or omitted, and certain features of the disclosure may be utilized independently, all as would be apparent to one skilled in the art after having the benefit of this description of the disclosure. Changes may be made in the elements described herein without departing from the spirit and scope of the disclosure as described in the following claims. Headings used herein are for organizational purposes and are not meant to be used to limit the scope of the description.

As used throughout this application, the word "may" is used in a permissive sense (i.e., meaning having the potential to), rather than the mandatory sense (i.e., meaning must). The words "include," "including," and "includes" mean including, but not limited to. As used throughout this application, the singular forms "a", "an," and "the" include plural referents unless the content clearly indicates otherwise. Thus, for example, reference to "an element" may include a combination of two or more elements. As used throughout this application, the phrase "based on" does not limit the associated operation to being solely based on a particular item. Thus, for example, processing "based on" data A may include processing based at least in part on data A and based at least in part on data B unless the content clearly indicates otherwise. As used throughout this application, the term "from" does not limit the associated operation to being directly from. Thus, for example, receiving an item "from" an entity may include receiving an item directly from the entity or indirectly from the entity (e.g., via an intermediary entity). Unless specifically stated otherwise, as apparent from the discussion, it is appreciated that throughout this specification discussions utilizing terms such as "processing," "computing," "calculating," "determining," or the like refer to actions or processes of a specific apparatus, such as a special purpose computer or a similar special purpose electronic processing/computing device. In the context of this specification, a special purpose computer or a similar special purpose electronic processing/computing device is capable of manipulating or transforming signals, typically represented as physical electronic or magnetic quantities within memories, registers, or other information storage devices, transmission devices, or display devices of the special purpose computer or similar special purpose electronic processing/computing device.

What is claimed is:

1. A method comprising:

monitoring a relationship between a first characteristic of a formation fluid extracted from a formation and a second characteristic of the formation fluid extracted from the formation, wherein the first characteristic of the formation fluid extracted from the formation or the second characteristic of the formation fluid extracted from the formation comprises a fluid density, an optical density, or a fluid conductivity;

determining, based at least in part on the monitoring, that a non-linear trend is exhibited by the relationship between the first characteristic of the formation fluid extracted from the formation and the second characteristic of the formation fluid extracted from the formation over at least a first threshold amount of time or a first threshold amount of pumping volume;

determining, based at least in part on the monitoring, that a linear trend is exhibited by the relationship between the first characteristic of the formation fluid extracted from the formation and the second characteristic of the formation fluid extracted from the formation over at least a second threshold amount of time or a second threshold amount of pumping volume;

determining that an initial point of reservoir fluid breakthrough has occurred based at least in part on an identified transition from the non-linear trend of the relationship to the linear trend of the relationship, wherein the reservoir fluid breakthrough is indicative of virgin reservoir fluid entering a sampling tool comprising a focused sampling tool comprising a sample flowline and a guard flowline; and in response to identifying that the reservoir fluid breakthrough has occurred, operating the sampling tool in a split-flow configuration such that a first portion of the formation fluid is directed into the sample flowline and a second portion of the formation fluid is directed into the guard flowline.

2. The method of claim 1, wherein the sample flowline is configured to provide a first conduit for a flow of formation fluid extracted from the formation, wherein the guard flowline is configured to provide a second conduit for flow of formation fluid extracted from the formation, and wherein the sampling tool comprises:

a sample pump configured to generate the flow of formation fluid through the sample flowline; and a guard pump configured to generate the flow of formation fluid through the guard flowline; and wherein operating the sampling tool in the split-flow configuration comprises:

simultaneously operating both of the sample pump and the guard pump to generate the flow of formation fluid through the sample flowline and the guard flowline.

3. The method of claim 1, wherein sampling the formation fluid directed into the sample flowline comprises acquiring a sample of the formation fluid directed into the sample flowline, and wherein the method further comprises:

determining one or more characteristics of virgin formation fluid of the formation based at least in part on the sample.

4. The method of claim 1, wherein the method further comprises:

in response to identifying that the reservoir fluid breakthrough has occurred:

identifying an interval that begins and ends after the reservoir fluid breakthrough;

identifying a set of optical density data that corresponds to the identified interval;

conducting a normalization procedure using the set of optical density data that corresponds to the identified interval; and estimating a contamination level of the formation fluid based at least in part on results of the normalization procedure.

5. The method of claim 1, wherein the first characteristic comprises the fluid density and wherein the second characteristic comprises the optical density.

6. The method of claim 1, wherein the first characteristic comprises a first optical density corresponding to optical measurements using a first wavelength of light, and the second characteristic comprises a second optical density corresponding to optical measurements using a second wavelength of light.

7. The method of claim 1, wherein the first characteristic comprises the fluid conductivity and the second characteristic comprises the fluid density.

8. The method of claim 1, wherein the formation fluid comprises oil.

9. The method of claim 1, wherein the formation fluid comprises water.

10. The method of claim 1, wherein the linear trend comprises a build-up trend or a build-down trend.

11. The method of claim 1, wherein monitoring the relationship between the first characteristic of the formation fluid extracted from the formation and the second characteristic of the formation fluid extracted from the formation comprises:

acquiring downhole data; and identifying, in real-time, the relationship between the first characteristic of the formation fluid extracted from the formation and the second characteristic of the formation fluid extracted from the formation using the downhole data; and displaying, in real-time in a graphical user interface, a cross-plot of the relationship between the first characteristic of the formation fluid extracted from the formation and the second characteristic of the formation fluid.

12. The method of claim 1, comprising:

monitoring a contamination level of the formation fluid directed into the sample flowline;

determining that the contamination level of the formation fluid directed into the sample flowline falls below a contamination threshold; and in response to determining that the contamination level of the formation fluid directed into the sample flowline falls below the contamination threshold, sampling the formation fluid directed into the sample flowline.

13. A method comprising:

monitoring a relationship between a first characteristic of a formation fluid extracted from a formation and a second characteristic of the formation fluid extracted from the formation, wherein the first characteristic of the formation fluid extracted from the formation or the second characteristic of the formation fluid extracted from the formation comprises a fluid density, an optical density, or a fluid conductivity;

determining, based at least in part on the monitoring, that a non-linear trend is exhibited by the relationship between the first characteristic of the formation fluid extracted from the formation and the second characteristic of the formation fluid extracted from the formation over at least a first threshold amount of time or a first threshold amount of pumping volume;

determining, based at least in part on the monitoring, that a linear trend is exhibited by the relationship between the first characteristic of the formation fluid extracted from the formation and the second characteristic of the formation fluid extracted from the formation over at least a second threshold amount of time or a second threshold amount of pumping volume;

determining that an initial point of reservoir fluid breakthrough has occurred based at least in part on an identified transition from the non-linear trend of the relationship to the linear trend of the relationship, wherein the reservoir fluid breakthrough is indicative of virgin reservoir fluid entering a sampling tool; and in response to identifying the reservoir fluid breakthrough:

identifying an interval that begins and ends after the reservoir fluid breakthrough;

identifying a set of optical density data that corresponds to the identified interval;

conducting a normalization procedure using the set of optical density data that corresponds to the identified interval;

estimating a contamination level of the formation fluid based at least in part on results of the normalization procedure; and in response to estimating the contamination level of the formation fluid, sampling the formation fluid into a container in the sampling tool.

* * * * *